US009180472B2

(12) United States Patent
Munn et al.

(10) Patent No.: US 9,180,472 B2
(45) Date of Patent: Nov. 10, 2015

(54) PAINT SPRAYER

(75) Inventors: Jamie S. Munn, Maitland (CA); Graeme Crawley, Newcastle upon Tyne (GB); James D. Marshall, Gananoque (CA); Stacey Black, Stittsville (CA); Oleksiy P. Sergyeyenko, Ottawa (CA); Robert J. B. Hobden, Kingston (CA); Corey D. MacTavish, Nepean (CA)

(73) Assignee: BLACK & DECKER INC., Newark, DE (US)

( * ) Notice: Subject to any disclaimer, the term of this patent is extended or adjusted under 35 U.S.C. 154(b) by 526 days.

(21) Appl. No.: 12/947,921

(22) Filed: Nov. 17, 2010

(65) Prior Publication Data

US 2011/0198412 A1 Aug. 18, 2011

Related U.S. Application Data

(60) Provisional application No. 61/390,165, filed on Oct. 5, 2010, provisional application No. 61/261,953, filed on Nov. 17, 2009.

(51) Int. Cl.
*B05B 15/02* (2006.01)
*B05B 9/08* (2006.01)
(Continued)

(52) U.S. Cl.
CPC ..... *B05B 9/0861* (2013.01); *B05B 9/01* (2013.01); *B05B 15/025* (2013.01); *B05B 7/2472* (2013.01)

(58) Field of Classification Search
CPC .... B05B 7/2462; B05B 7/2472; B05B 9/085; B05B 9/0855; B05B 9/0861; B05B 12/025; B05B 15/025; B05B 9/01
USPC ..... 239/112, 113, 303–305, 331–334
See application file for complete search history.

(56) References Cited

U.S. PATENT DOCUMENTS 1,799,143 A 4/1931 Bailey
1,807,490 A 5/1931 Milner
(Continued)

FOREIGN PATENT DOCUMENTS

CN 1150396 A 5/1997
CN 1640561 A 7/2005
(Continued)

OTHER PUBLICATIONS

PCT International Search Report and Written Opinion for International Appln. No. PCT/US2010/057042 dated Apr. 21, 2011, 12 pages.
(Continued)

*Primary Examiner* — Christopher Kim
(74) *Attorney, Agent, or Firm* — Stephen R. Valancius

(57) ABSTRACT

A sprayer can include a sprayer body, a reservoir coupled to the sprayer body, a cleaning fluid reservoir coupled to the sprayer body and a pump assembly arranged within the sprayer body and coupled to the reservoir and the cleaning fluid reservoir. The pump assembly can include a pump barrel that defines a central aperture, a piston arranged within the central aperture, a solenoid coupled to the piston and configured to reciprocate the piston within the central aperture during operation of the sprayer, and a manifold assembly coupled to the pump barrel and including a valve member movable between a first position and a second position. The valve member can fluidly couple the central aperture with the reservoir in the first position and fluidly couple the central aperture with the cleaning fluid reservoir in the second position.

16 Claims, 23 Drawing Sheets

(51) Int. Cl.

| | |
|---|---|
| ***B05B 9/01*** | (2006.01) |
| *B05B 7/24* | (2006.01) |

(56) References Cited

U.S. PATENT DOCUMENTS

| | | | | | |
|---|---|---|---|---|---|
| 1,919,233 | A | | 7/1933 | Lee | |
| 1,948,401 | A | * | 2/1934 | Smith et al. | 137/255 |
| 2,098,014 | A | | 11/1937 | Polston | |
| 2,105,681 | A | | 1/1938 | Armstrong | |
| 2,200,675 | A | * | 5/1940 | Northcutt | 137/264 |
| 2,339,379 | A | * | 1/1944 | Cook | 239/305 |
| 2,455,240 | A | | 11/1948 | Dupler | |
| 2,456,493 | A | | 12/1948 | Drane et al. | |
| 2,540,357 | A | | 2/1951 | Stanley | |
| 2,888,207 | A | | 5/1959 | Sykes | |
| 3,191,869 | A | | 6/1965 | Gilmour | |
| 3,428,291 | A | | 2/1969 | Callahan, Jr. et al. | |
| 3,795,366 | A | | 3/1974 | McGhie et al. | |
| 3,816,165 | A | | 6/1974 | Horvath et al. | |
| RE29,055 | E | | 11/1976 | Wagner | |
| 4,106,181 | A | | 8/1978 | Mattchen | |
| 4,137,952 | A | | 2/1979 | Rendemonti | |
| 4,228,957 | A | | 10/1980 | Davini | |
| 4,245,784 | A | | 1/1981 | Garcin | |
| 4,278,205 | A | | 7/1981 | Binoche | |
| 4,349,947 | A | | 9/1982 | Rood | |
| 4,365,745 | A | | 12/1982 | Beck | |
| 4,433,799 | A | | 2/1984 | Corsette | |
| 4,442,977 | A | | 4/1984 | Beiswenger et al. | |
| 4,483,483 | A | | 11/1984 | Grime | |
| 4,501,500 | A | | 2/1985 | Terrels | |
| 4,537,357 | A | | 8/1985 | Culbertson et al. | |
| 4,551,037 | A | | 11/1985 | Kille et al. | |
| 4,569,366 | A | | 2/1986 | West et al. | |
| 4,569,503 | A | | 2/1986 | Karr, Jr. | |
| 4,692,049 | A | | 9/1987 | Engle | |
| 4,693,423 | A | | 9/1987 | Roe et al. | |
| 4,735,362 | A | | 4/1988 | Trautwein et al. | |
| 4,804,144 | A | | 2/1989 | Denman | |
| 4,811,904 | A | | 3/1989 | Ihmels et al. | |
| 4,884,742 | A | | 12/1989 | Bekius et al. | |
| 4,936,511 | A | | 6/1990 | Johnson et al. | |
| 4,971,251 | A | | 11/1990 | Dobrick et al. | |
| 4,993,596 | A | | 2/1991 | Brown | |
| 5,009,367 | A | | 4/1991 | Nielsen | |
| 5,033,552 | A | | 7/1991 | Hu | |
| 5,052,623 | A | * | 10/1991 | Nordeen | 239/305 |
| 5,056,717 | A | | 10/1991 | Koide | |
| 5,057,342 | A | | 10/1991 | Hoy et al. | |
| 5,060,869 | A | | 10/1991 | Bekius | |
| 5,090,623 | A | | 2/1992 | Burns et al. | |
| 5,119,992 | A | | 6/1992 | Grime | |
| 5,141,156 | A | | 8/1992 | Hoy et al. | |
| 5,141,162 | A | * | 8/1992 | Gunderson et al. | 239/332 |
| 5,217,168 | A | | 6/1993 | Svendsen | |
| 5,281,782 | A | | 1/1994 | Conatser | |
| 5,284,299 | A | | 2/1994 | Medlock | |
| 5,395,051 | A | | 3/1995 | Anderson et al. | |
| 5,609,302 | A | | 3/1997 | Smith | |
| 5,630,552 | A | | 5/1997 | Anfindsen et al. | |
| 5,687,913 | A | | 11/1997 | Robisch et al. | |
| 5,706,856 | A | | 1/1998 | Lancaster | |
| 5,779,157 | A | | 7/1998 | Robisch et al. | |
| 5,803,367 | A | | 9/1998 | Heard et al. | |
| 5,826,795 | A | | 10/1998 | Holland et al. | |
| 5,836,517 | A | | 11/1998 | Burns et al. | |
| 5,927,602 | A | | 7/1999 | Robisch et al. | |
| 5,934,887 | A | | 8/1999 | Veit | |
| 5,949,209 | A | | 9/1999 | Okamoto et al. | |
| 5,992,690 | A | | 11/1999 | Tracy | |
| 6,000,419 | A | | 12/1999 | Bernhard | |
| 6,009,899 | A | | 1/2000 | Polutnik | |
| 6,089,471 | A | | 7/2000 | Scholl | |
| 6,106,742 | A | | 8/2000 | Argyropoulos et al. | |
| 6,189,804 | B1 | | 2/2001 | Vetter et al. | |
| 6,247,995 | B1 | | 6/2001 | Bryan | |
| 6,263,980 | B1 | | 7/2001 | Wadge | |
| 6,286,611 | B1 | | 9/2001 | Bone | |
| 6,383,062 | B1 | | 5/2002 | Jou | |
| 6,390,386 | B2 | | 5/2002 | Krohn et al. | |
| 6,431,466 | B1 | | 8/2002 | Kitajima | |
| 6,527,200 | B1 | | 3/2003 | Huang | |
| 6,547,161 | B1 | | 4/2003 | Huang | |
| 6,553,642 | B2 | | 4/2003 | Driessen | |
| 6,623,561 | B2 | | 9/2003 | Vetter et al. | |
| 6,631,855 | B2 | | 10/2003 | Huang | |
| 6,675,911 | B2 | | 1/2004 | Driessen | |
| 6,702,203 | B2 | | 3/2004 | Jou | |
| 6,805,306 | B1 | | 10/2004 | Huang | |
| 6,824,075 | B2 | | 11/2004 | Zimmermann | |
| 6,874,702 | B2 | | 4/2005 | Turnbull | |
| 6,971,590 | B2 | | 12/2005 | Blette et al. | |
| 7,017,835 | B2 | | 3/2006 | Vetter et al. | |
| 7,021,399 | B2 | | 4/2006 | Driessen | |
| 7,032,839 | B2 | | 4/2006 | Blette et al. | |
| 7,069,948 | B2 | | 7/2006 | Lovell | |
| 7,121,299 | B2 | | 10/2006 | Lumello | |
| 7,185,672 | B2 | | 3/2007 | Lovell | |
| 7,201,336 | B2 | | 4/2007 | Blette et al. | |
| 7,207,497 | B2 | | 4/2007 | Clark | |
| 7,246,759 | B2 | | 7/2007 | Turnbull | |
| 7,250,023 | B2 | | 7/2007 | Bai | |
| 7,347,136 | B2 | | 3/2008 | Bruggeman et al. | |
| 7,360,720 | B2 | | 4/2008 | Gohring et al. | |
| 7,374,377 | B2 | | 5/2008 | Bauman | |
| 7,431,223 | B2 | | 10/2008 | Gohring | |
| 7,484,676 | B2 | | 2/2009 | Joseph et al. | |
| 7,540,434 | B2 | | 6/2009 | Gohring et al. | |
| 7,549,449 | B2 | | 6/2009 | Herre et al. | |
| 2002/0166905 | A1 | | 11/2002 | Huang | |
| 2003/0201340 | A1 | | 10/2003 | Hanson | |
| 2004/0164182 | A1 | | 8/2004 | Joseph et al. | |
| 2005/0150521 | A1 | | 7/2005 | Jones et al. | |
| 2005/0269425 | A1 | | 12/2005 | Gohring et al. | |
| 2005/0279517 | A1 | | 12/2005 | Hoffman et al. | |
| 2006/0005766 | A1 | | 1/2006 | Gorges et al. | |
| 2006/0275555 | A1 | | 12/2006 | Colizza et al. | |
| 2007/0278787 | A1 | | 12/2007 | Jones et al. | |
| 2008/0029619 | A1 | | 2/2008 | Gohring et al. | |
| 2008/0217442 | A1 | | 9/2008 | Anfindsen et al. | |
| 2008/0226407 | A1 | | 9/2008 | Bauman | |
| 2008/0296409 | A1 | | 12/2008 | Micheli | |
| 2009/0145980 | A1 | | 6/2009 | Jones | |
| 2009/0230218 | A1 | | 9/2009 | Drozd | |
| 2009/0277976 | A1 | | 11/2009 | Micheli et al. | |
| 2009/0302133 | A1 | | 12/2009 | Micheli et al. | |
| 2010/0163654 | A1 | | 7/2010 | Bass et al. | |

FOREIGN PATENT DOCUMENTS

| | | | |
|---|---|---|---|
| CN | 1706557 | A | 12/2005 |
| CN | 101081383 | A | 12/2007 |
| CN | 101125317 | A | 2/2008 |
| DE | 8713954 | U1 | 12/1987 |
| DE | 202007003070 | U1 | 7/2008 |
| DE | 202008009203 | U1 | 9/2008 |
| EP | 0513626 | A1 | 11/1992 |
| GB | 290866 | A | 5/1928 |
| GB | 2063424 | A | 6/1981 |
| JP | 63-020965 | U | 2/1988 |
| JP | 5212323 | A | 8/1993 |
| JP | 10507249 | T | 7/1998 |
| JP | 10510209 | T | 10/1998 |
| JP | 2003088781 | A | 3/2003 |
| WO | 9617689 | A1 | 6/1996 |
| WO | 9809073 | A1 | 3/1998 |
| WO | 02072276 | A1 | 9/2002 |

(56) References Cited

FOREIGN PATENT DOCUMENTS

| | | | |
|---|---|---|---|
| WO | 2004025123 | A1 | 3/2004 |
| WO | 2006087055 | A1 | 8/2006 |
| WO | 2010047800 | A2 | 4/2010 |

OTHER PUBLICATIONS

PCT International Search Report and Written Opinion for International Appln. No. PCT/US2010/057033 dated Mar. 17, 2011, 8 pages.

PCT International Search Report and Written Opinion for International Appln. No. PCT/US2010/057041 dated Mar. 17, 2011, 10 pages.

PCT International Search Report and Written Opinion for International Appln. No. PCT/US2010/057050 dated Mar. 14, 2011, 8 pages.

* cited by examiner

PAINT SPRAYER

CROSS-REFERENCE TO RELATED APPLICATIONS

This application claims the benefit of U.S. Provisional Application No. 61/390,165, filed on Oct. 5, 2010 and U.S. Provisional Application No. 61/261,953, filed on Nov. 17, 2009. The entire disclosures of each of the above applications are incorporated herein by reference.

FIELD

The present disclosure relates to a sprayer for spraying fluids including paints and stains.

BACKGROUND

Typically, when changing paint in a paint sprayer, the "wet" components (reservoir, nozzle, etc.) of the paint sprayer are cleaned before different paint is introduced. Cleaning the "wet" components of a paint sprayer can be a cumbersome and difficult task. For example, cleaning the reservoir can expose the sprayer body and pump to the cleaning process. In certain examples where portions of the housing detach with the reservoir, the process to separate the housings can be relatively complex and require two hands to perform.

SUMMARY

This section provides a general summary of the disclosure, and is not a comprehensive disclosure of its full scope or all of its features.

In some embodiments of the present disclosure, a sprayer can include a sprayer body, a reservoir coupled to the sprayer body, a cleaning fluid reservoir coupled to the sprayer body and a pump assembly arranged within the sprayer body and coupled to the reservoir and the cleaning fluid reservoir. The pump assembly can include a pump barrel that defines a central aperture, a piston arranged within the central aperture, a solenoid coupled to the piston and configured to reciprocate the piston within the central aperture during operation of the sprayer, and a manifold assembly coupled to the pump barrel and including a valve member movable between a first position and a second position. The valve member can fluidly couple the central aperture with the reservoir in the first position and fluidly couple the central aperture with the cleaning fluid reservoir in the second position.

In other embodiments, a sprayer can include a sprayer body, a reservoir coupled to the sprayer body, a cleaning fluid reservoir coupled to the sprayer body and a pump assembly arranged within the sprayer body and coupled to the reservoir and the cleaning fluid reservoir. The pump assembly can include a pump barrel that defines a central aperture, a piston arranged within the central aperture, a solenoid coupled to the piston and configured to reciprocate the piston within the central aperture during operation of the sprayer, and a manifold assembly coupled to the pump barrel and including a manifold structure, a flange and a valve member movable between a first position and a second position. The valve member can fluidly couple the central aperture with the reservoir in the first position and fluidly couple the central aperture with the cleaning fluid reservoir in the second position. The valve member can be rotated between the first and second positions. The valve member can include a first valve conduit and a second valve conduit, the valve member fluidly coupling the first valve conduit with the central aperture in the first position and fluidly coupling the second valve conduit with the central aperture in the second position. The second valve conduit can be sealingly disposed with the manifold structure in the first position.

In various other embodiments, a sprayer can include a sprayer body, a reservoir coupled to the sprayer body, a cleaning fluid reservoir coupled to the sprayer body and a pump assembly arranged within the sprayer body and coupled to the reservoir and the cleaning fluid reservoir. The pump assembly can include a pump barrel that defines a central aperture, a piston arranged within the central aperture, a solenoid coupled to the piston and configured to reciprocate the piston within the central aperture during operation of the sprayer, and a manifold assembly coupled to the pump barrel and including a manifold structure, a flange and a valve member movable between a first position and a second position. The valve member can fluidly couple the central aperture with the reservoir in the first position and fluidly couple the central aperture with the cleaning fluid reservoir in the second position. The valve member can be translated between the first and second positions. The valve member can include at least one valve element that includes a first engaging portion, a second engaging portion and a body portion extending between the first and second engaging portion. The second engaging portion can sealingly engage the manifold structure in the first position to block fluid flow from the cleaning fluid reservoir into the central aperture.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected aspects of the present teachings and not all possible implementations, and are not intended to limit the scope of the present teachings.

Corresponding reference numerals indicate corresponding parts throughout the several views of the drawings.

DETAILED DESCRIPTION

Example aspects of the present teachings will now be described more fully with reference to the accompanying drawings.

Figure 1:
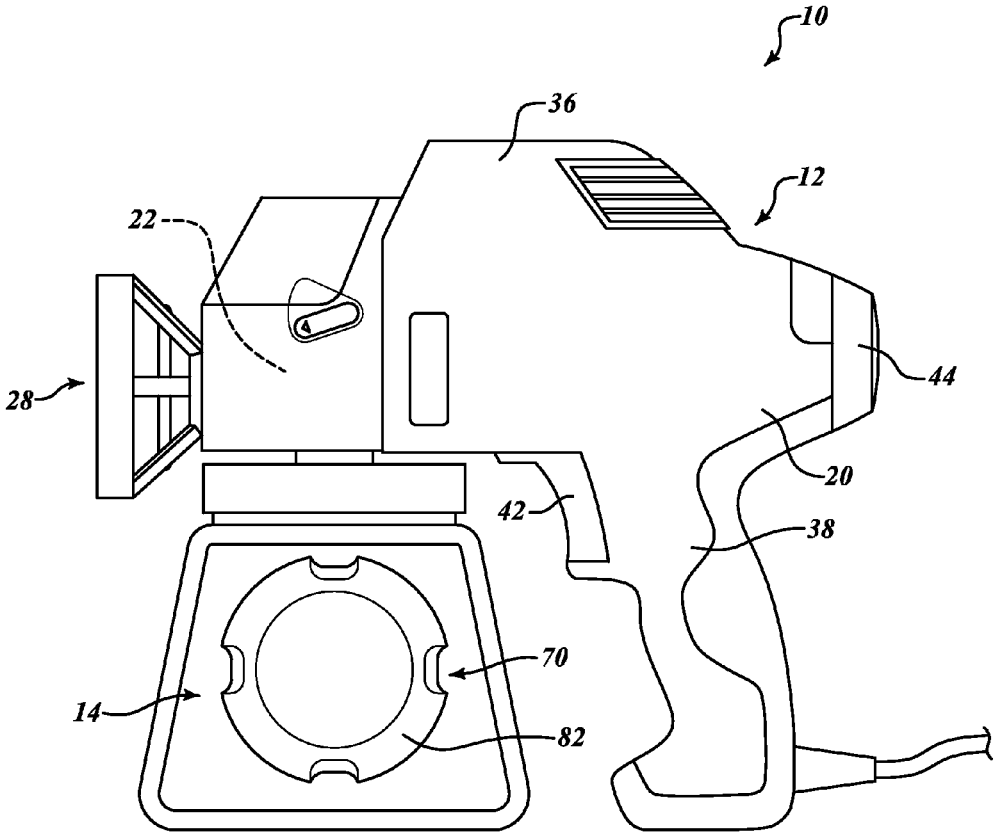
FIG. 1 is a side elevation of an exemplary sprayer constructed in accordance with the teachings of the present disclosure.

With reference to FIG. 1 of the drawings, a first sprayer constructed in accordance with the teachings of the present disclosure is generally indicated by reference numeral 10. The sprayer 10 can include a sprayer body 12 and a reservoir 14 that can be removably coupled to the sprayer body 12. In the particular example provided, the sprayer 10 additionally comprises a second, optional reservoir 14*a* that is illustrated in FIG. 2.

Figure 2:
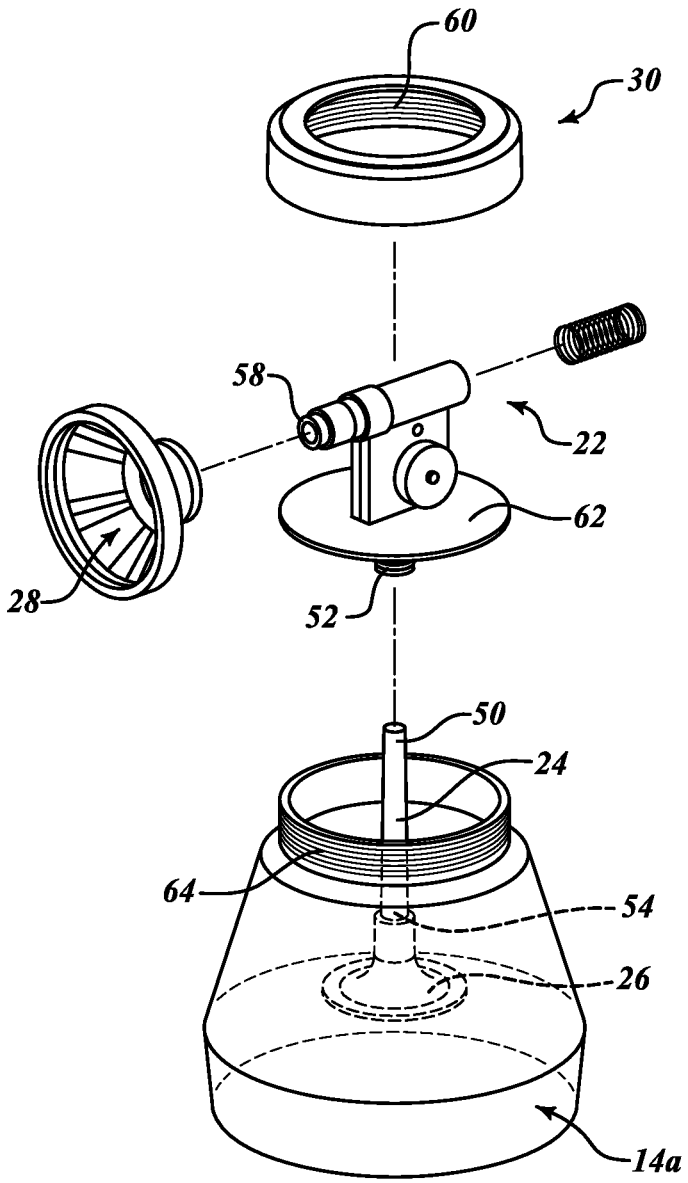
FIG. 2 is an exploded perspective view of a portion of the sprayer of FIG. 1 illustrating a portion of the pump assembly and the nozzle with a second reservoir.

With reference to FIGS. 1 and 2, the sprayer body 12 can comprise a housing 20, a pump assembly 22, a supply tube 24, a filter system 26, a nozzle 28 and a collar 30. The housing 20 can be formed of one or more housing components, such as a pair of clam shell housing halves, and can include a housing body 36 and a handle 38. The pump assembly 22 can be received in the housing body 36 and can include a suitable pump, such as a solenoid operated piston pump, that can be employed to draw a liquid, such as a paint or a stain, from the reservoir 14 or 14*a*. The pump assembly 22 can comprise one or more controllers that can be employed by an operator of the sprayer 10 to control one or more aspects of the sprayer 10. In the example provided, the pump assembly 22 includes a trigger 42, which can be employed to selectively operate the pump assembly 22, and a spray adjuster 44 that can be employed to control the amount of liquid that is output from the pump assembly 22. The supply tube 24 can have a proximal end 50, which can be coupled to an inlet 52 of the pump assembly 22, and a distal end 54 that can extend into the reservoir 14 or 14*a*. The filter system 26 is configured to filter the liquid that is drawn into the supply tube 24 by the pump assembly 22 and can shroud the distal end 54 of the supply tube 24 and/or be coupled in fluid connection to the distal end 54 of the supply tube 24. The nozzle 28 can be coupled to an output 58 of the pump assembly 22. The collar 30 can be fixedly coupled or fixedly but removably coupled to the housing 20 or the pump assembly 22 and can be configured to facilitate the coupling of the reservoir 14 or 14*a* to the sprayer body 12. In the particular example provided, the collar 30 comprises an annular threaded member 60 that can be received over a flange 62 of the pump assembly 22. The annular threaded member 60 may be threadably coupled to a corresponding neck 64 on the reservoir 14 or 14*a* in a manner that is well known in the art. Moreover, one or more seals may be employed between the collar 30 and the pump assembly 22, and/or the collar 30 and the neck 64, and/or the flange 62 and the neck 64 to seal one or more of the interfaces between the reservoir 14 or 14*a*, the pump assembly 22 and/or the collar 30.

As will be appreciated, either of the reservoirs 14 and 14*a* may be filled by first uncoupling the reservoir 14 or 14*a* from the sprayer body 12 and then pouring a desired liquid through the neck 64 into the reservoir 14 or 14*a*. As will also be appreciated from this disclosure, liquid on the supply tube 24 and/or the filter system 26 can drip or spill onto the floor or another object when the sprayer body 12 is separated from the reservoir 14 or 14*a* during the filling of the reservoir 14 or 14*a*. Such drips and spills can be avoided through use of a second neck 70 on the reservoir 14.

Figure 3:
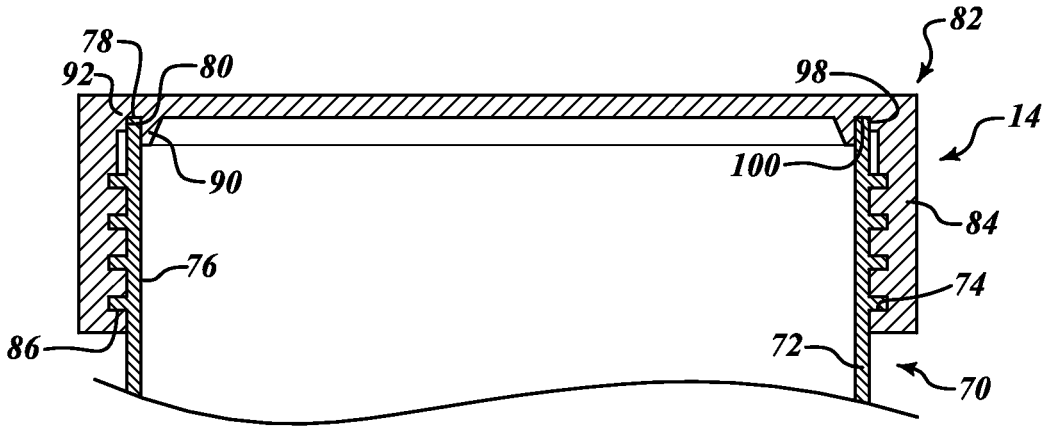
FIG. 3 is a section view of a portion of the sprayer of FIG. 1.

With reference to FIG. 3, the second neck 70 can comprise an annular neck member 72 and a plurality of threads 74 that can be disposed about the annular neck member 72. The annular neck member 72 can define an interior surface 76, an axial end face 78 and an exterior surface 80. In the example provided, the interior surface 76 and the exterior surface 80 are cylindrically shaped and are disposed concentrically, but it will be appreciated that the interior surface 76 and/or the exterior surface 80 could be shaped differently.

A cap 82 can be employed to sealingly close the second neck 70 and can comprise a cap body 84 and a seal system. The cap body 84 can comprise a plurality of threads 86 that can be threadably engaged to the threads 74 of the second neck 70. The seal system could comprise one or more seals that can be employed to sealingly engage the second neck 70 and/or the cap body 84 to inhibit the egress of fluids within the reservoir 14. In the particular example provided, the seal system is integrally formed with the cap body 84 and comprises an interior cap seal member 90 and an exterior cap seal member 92. The interior cap seal member 90 and the exterior cap seal member 92 can cooperate to define a cavity 98 that is somewhat smaller than the distal end of the annular neck member 72. When the cap 82 is rotated relative to the second neck 70, engagement of the threads 74 and 86 causes translation of the cap 82 toward the axial end face 78 such that the axial end face 78 is driven between the interior cap seal member 90 and the exterior cap seal member 92 and abutted against a mating surface 100 on the cap body 84. When the cap 82 is secured to the reservoir 14, the interior cap seal member 90 can be sealingly engaged to the interior surface 76 of the annular neck member 72 to form a first seal and the exterior cap seal member 92 can be sealingly engaged to the annular neck member 72 at the axial end face 78 and/or the exterior surface 80 to thereby form a second seal. It will be appreciated that the sprayer 10 need only be tipped on its side and the cap 82 removed to permit access to the interior of the reservoir 14 to fill or empty the reservoir as desired.

The reservoir 14 may be manufactured in various ways, including blow molding or a combination of injection molding and blow molding.

Figure 1A:
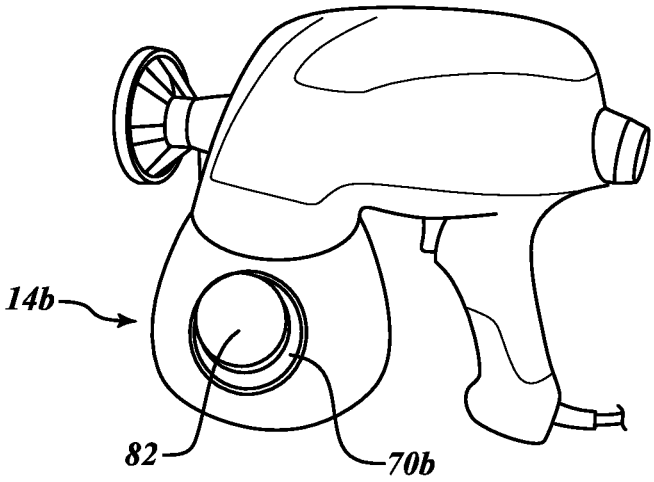
FIGS. 1A through 1C are perspective views of exemplary sprayers similar to the sprayer of FIG. 1.
Figure 1B:
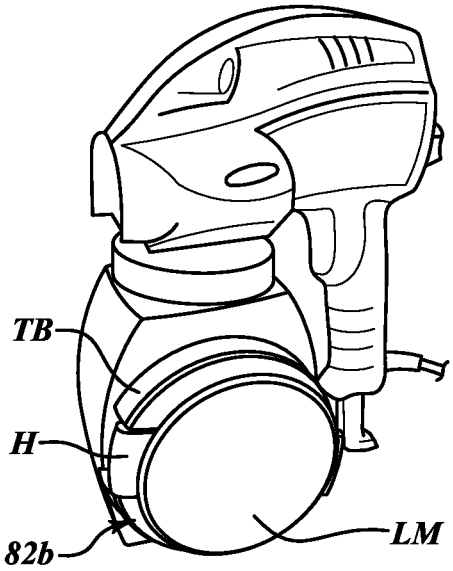
Figure 1C:
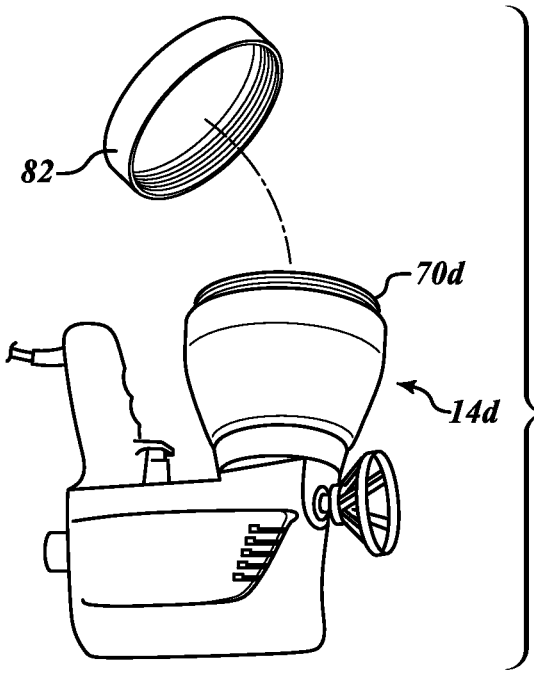

It will be appreciated that the reservoir 14 can be constructed somewhat differently from that which is depicted in FIGS. 1 and 3. With reference to FIG. 1A for example, the second neck 70*b* may extend from the body of the reservoir 14*b* in a direction that is upward and outward so that the reservoir 14*b* may be filled without tipping the sprayer 10. With reference to FIG. 1B, the cap 82*b* can include a threaded body TB and a lid member LM that is hingedly coupled (via a hinge H) to the threaded body TB. In FIG. 1C, the second neck 70*d* is formed on a side of the reservoir 14*d* opposite the sprayer body 12.

Figure 4:
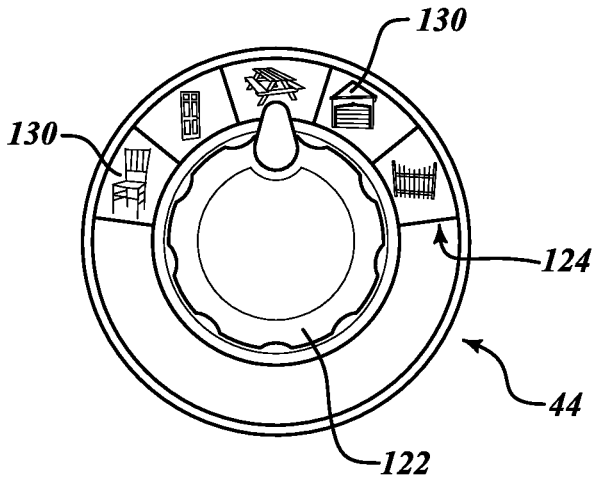
FIG. 4 is a side elevation view of a portion of the sprayer of FIG. 1 illustrating a controller for controlling an amount of liquid dispensed by the sprayer.

With reference to FIG. 4, the controllers for the pump assembly 22 (FIG. 2) in conjunction with the spray adjuster 44 can be configured to control the stroke of a piston pump, as well as the speed of the piston stroke. The spray adjuster 44 can comprise a knob 122 that can be rotated into one of a plurality of positions as selected by the operator of the sprayer. Moreover, a system of indicia 124 can be employed to communicate to the operator information concerning the placement of the knob 122 at a specific position. In a basic form, the system of indicia 124 can comprise words or numbers that relate to the volume of liquid that is dispensed when the sprayer is operated and the knob 122 is in a particular position. For example, a series of words (e.g., very small, small, medium, large, extra large) or a series of numbers (e.g., 1, 3, 7, 11, 19) could be employed. As another example, the system of indicia 124 can comprise a plurality of icons 130 that illustrate one or more tasks that could be performed satisfactorily when the knob 122 is placed in a specific position.

Figure 5A:
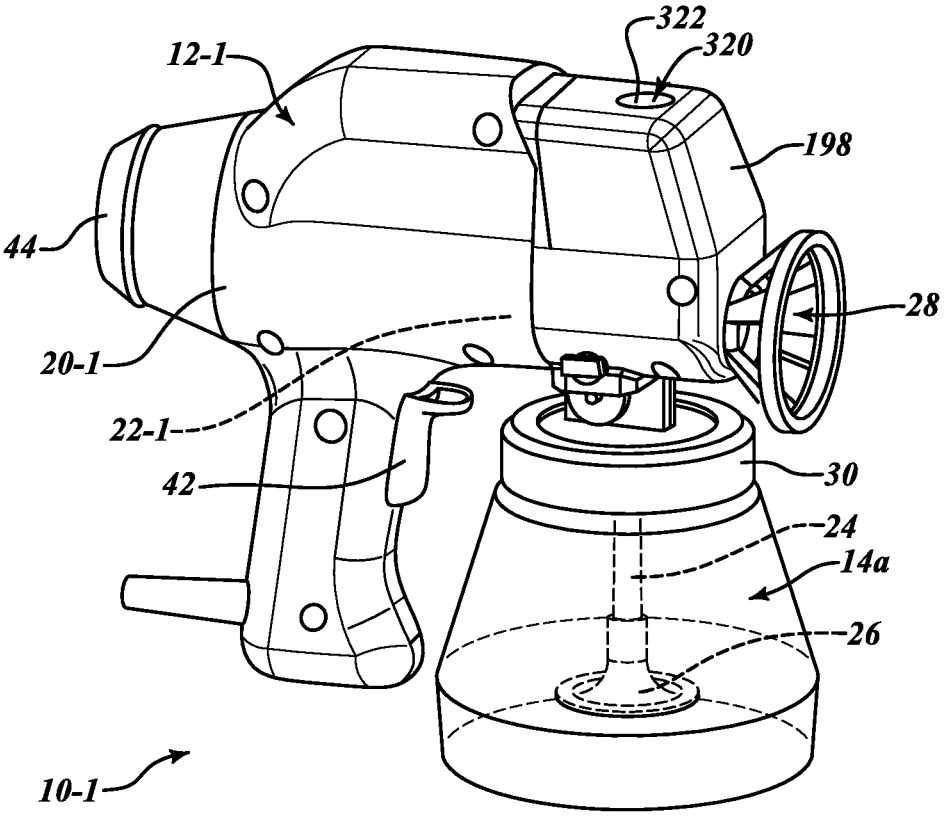
FIG. 5A is a right perspective view of another sprayer constructed in accordance with the teachings of the present disclosure.

With reference to FIG. 5A, a second sprayer constructed in accordance with the teachings of the present disclosure is generally indicated by reference numeral 10-1. The sprayer 10-1 can include a sprayer body 12-1 and a reservoir 14*a* that can be removably coupled to the sprayer body 12-1. The sprayer body 12-1 can comprise a housing 20-1, a pump assembly 22-1, a supply tube 24, a filter system 26, a nozzle 28, a collar 30 and a cleaning fluid reservoir 198.

Figure 6:
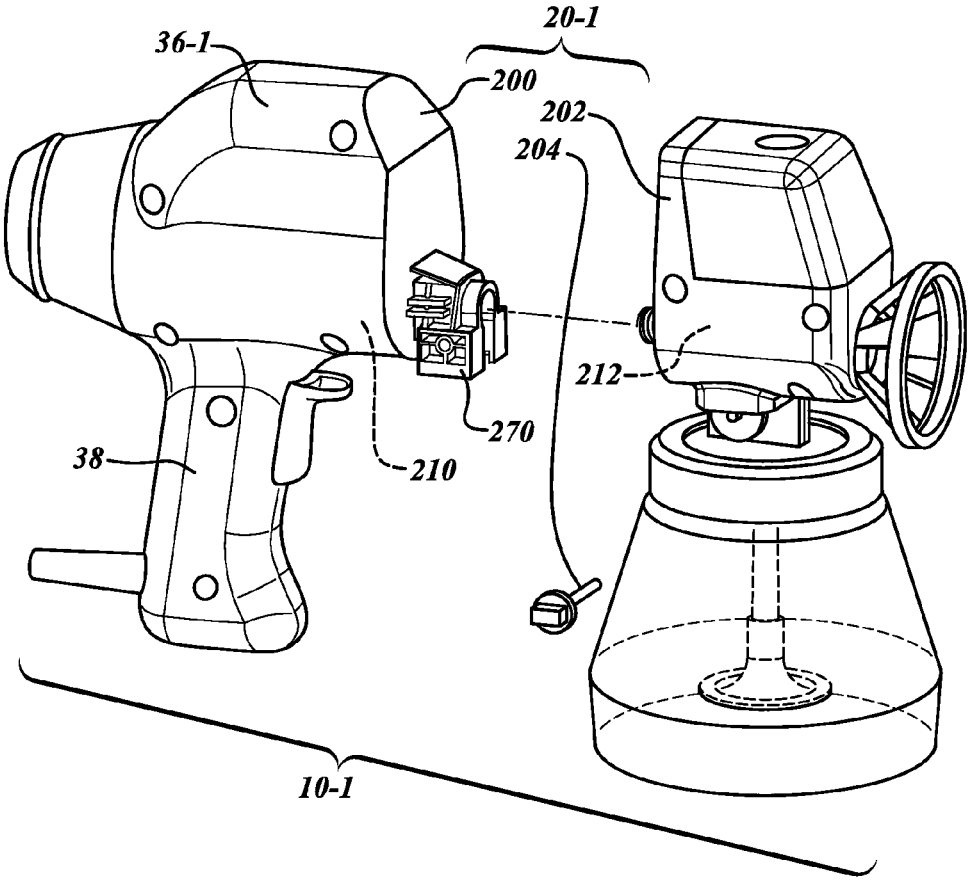
FIG. 6 is an exploded perspective view of the sprayer of FIG. 5A.

With reference to FIG. 6, the housing 20-1 can comprise one or more components, but in the example provided the housing 20-1 includes a first housing portion 200, a second housing portion 202 and a fastener 204 that is configured to permit the first and second housing portions 200 and 202 to be fixedly but removably coupled to one another. As those of skill in the art will appreciate, the fastener 204 can be any type of fastener, such as a threaded fastener, a detent pin, a ball-lock pin, an expanding pin, or a fastener that may be rotated through a predetermined angle (e.g., ¼ turn) to effect engagement.

The first housing portion 200 can be formed of a pair of clam shell housing halves, and can define a first housing body 36-1 and a handle 38. The second housing portion 202 can also be formed of a pair of clam shell housing halves.

Figure 9:
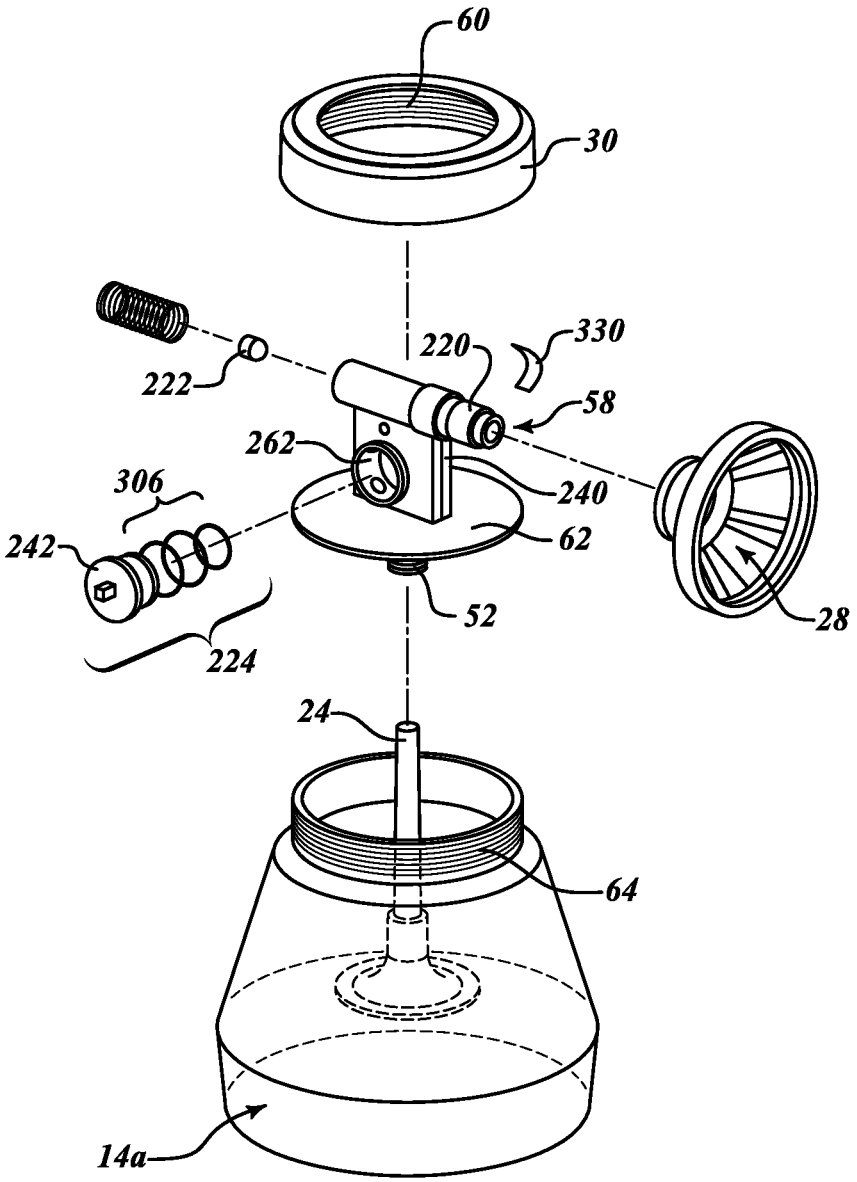
FIG. 9 is an exploded perspective view of a portion of the sprayer of FIG. 5A.

The pump assembly 22-1 can comprise a linear motor, such as a solenoid 210, that can be received in the first housing body 36, and a piston pump 212 that can be housed in the second housing portion 202. With reference to FIG. 9, the piston pump 212 can comprise a pump cylinder or barrel 220, a piston 222 and a manifold assembly 224. With reference to FIGS. 9 through 13, the pump barrel 220 can define a central aperture 230 that can be configured to receive a piston 222 that can be reciprocated within the pump barrel 220 to draw fluid from the reservoir 14*a* and expel the fluid from the nozzle 28. A supply or inlet aperture 234 and a drain or blowback aperture 236 can be formed through the pump barrel 220 so as to intersect the central aperture 230.

The manifold assembly 224 can comprise a flange 62, a manifold structure 240 and a valve member 242. The manifold structure 240 can be disposed between the pump barrel 220 and the flange 62 and can include a mounting aperture 250, a first supply conduit 252, a second supply conduit 254, a blowback conduit 256, a drain conduit 258, a cleaning solution supply conduit 260 and a valve body recess 262.

Figure 10:
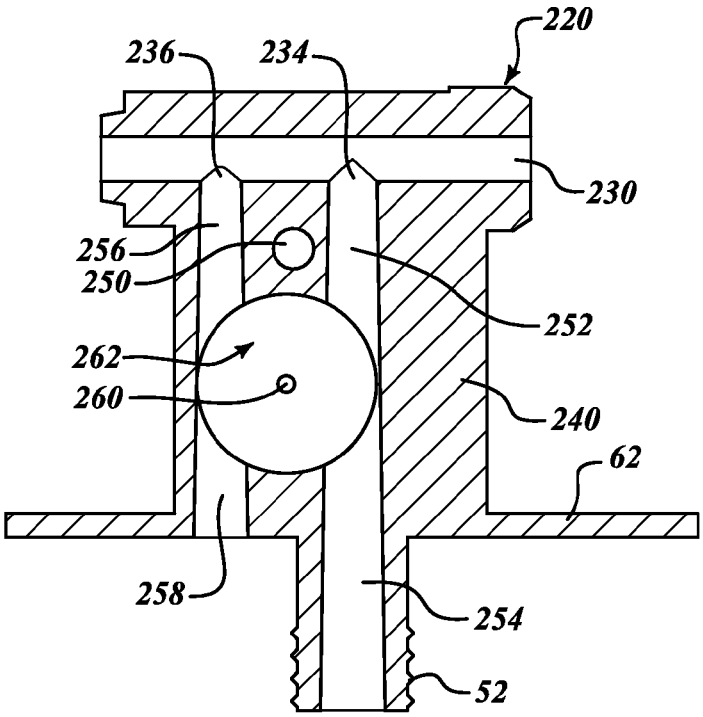
FIG. 10 is a sectional view of a portion of the sprayer of FIG. 5A illustrating a portion of the pump assembly in more detail.
Figure 11:
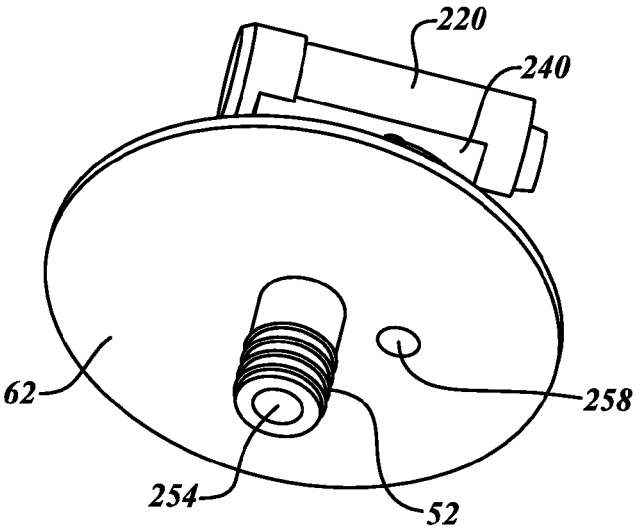
FIGS. 11 through 13 are perspective views of the portion of the pump assembly illustrated in FIG. 10.
Figure 12:
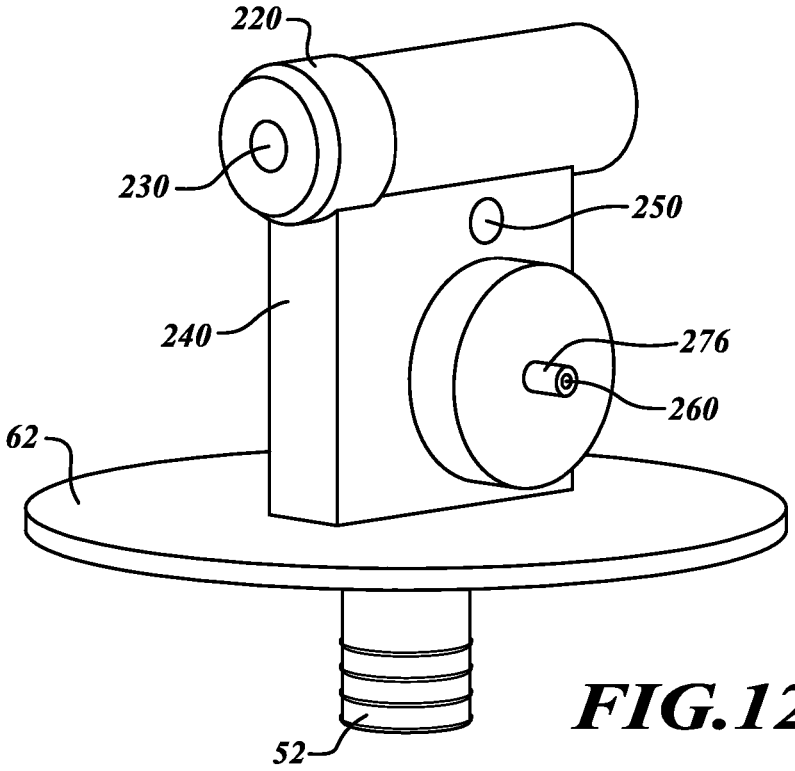
Figure 13:
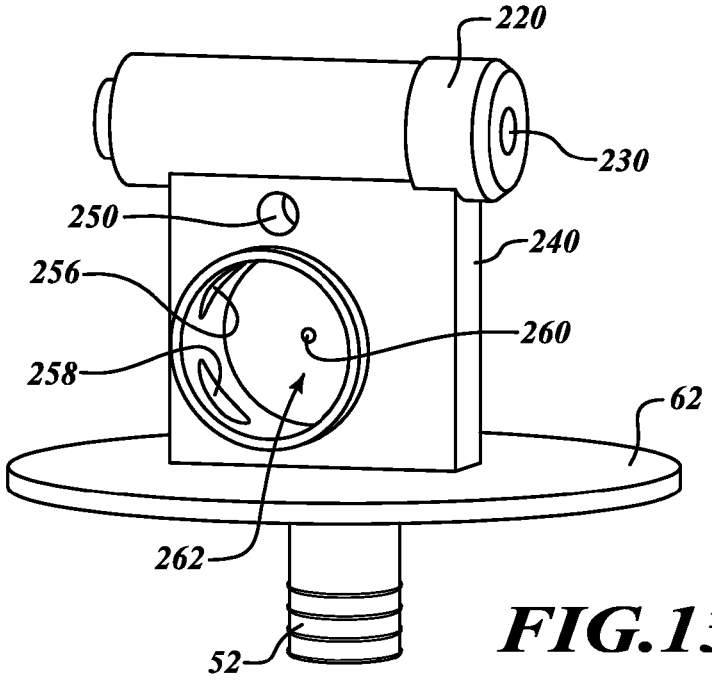

With reference to FIGS. 6 and 10, the mounting aperture 250 can be configured to receive the fastener 204 therethrough when the first and second housing portions 200 and 202 are coupled to one another. It will be appreciated that the solenoid 210 can include a mount 270 that can be configured to receive the pump barrel 220 and the manifold structure 240 and that the fastener 204 can be threadably engaged to the mount 270 to secure the pump barrel 220 to the solenoid 210. Construction in this manner provides access to the piston 222 (FIG. 9) and the pump barrel 220 for cleaning, as well as for replacement of the piston 222 (FIG. 9). The first supply conduit 252 can extend between (and fluidly couple) the inlet aperture 234 and the valve body recess 262. The second supply conduit 254 can extend between (and fluidly couple) the valve body recess 262 and the inlet 52 of the pump assembly 22-1. The blowback conduit 256 can extend between (and fluidly couple) the blowback aperture 236 and the valve body recess 262. The drain conduit 258 can extend from the valve body recess 262 and extend through the flange 62. The cleaning solution supply conduit 260 can extend from the valve body recess 262. In the particular example provided, the cleaning solution supply conduit 260 is located along the longitudinal axis (i.e., center) of the valve body recess 262 and terminates at a hose barb 276 (FIG. 12) on a side of the manifold structure 240 opposite valve body recess 262. The valve body recess 262 can be generally cylindrically shaped and the valve member 242 (FIG. 9) can be shaped in a mating manner.

Figure 14:
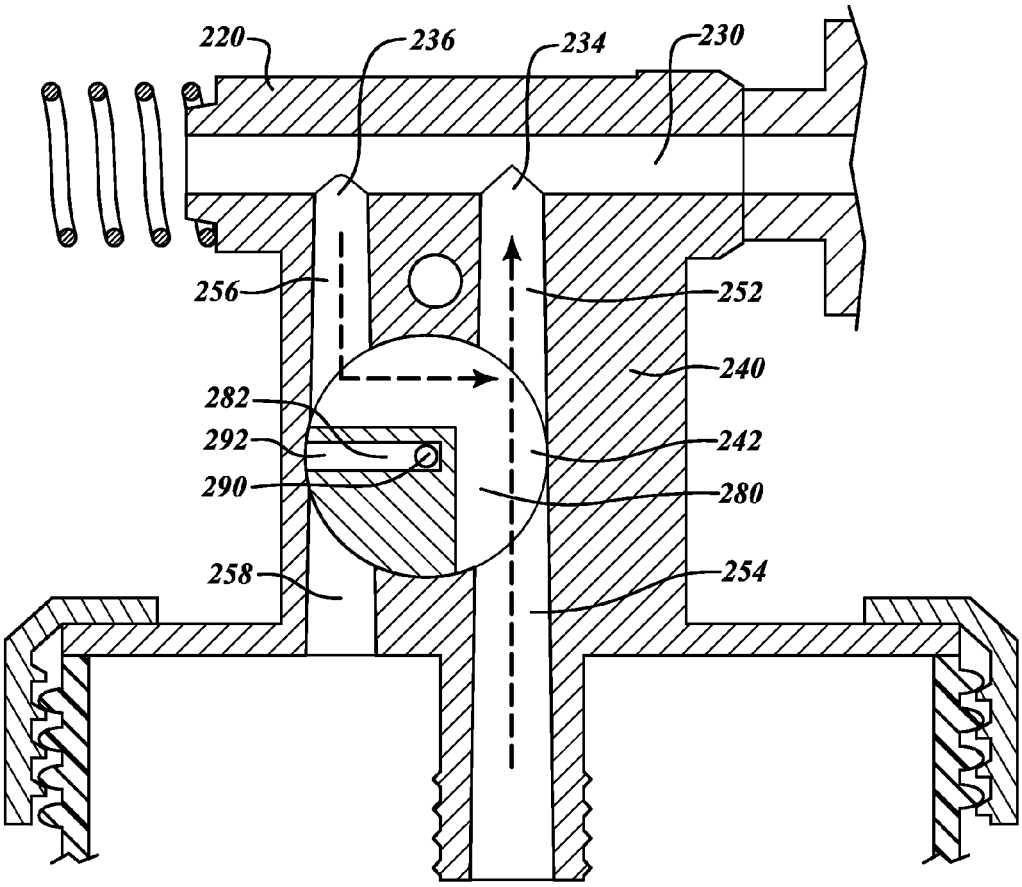
FIG. 14 is a section view of a portion of the sprayer of FIG. 5A illustrating the valve member in a first position.

With reference to FIGS. 9 and 14, the valve member 242 in the particular example provided comprises a first valve conduit 280 and a second valve conduit 282. The first valve conduit 280 can be a generally L-shaped slot in the outer cylindrical perimeter of the valve member 242, while the second valve conduit 282 comprises a first portion 290, which extends along the centerline or longitudinal axis of the valve member 242, and a second portion 292 that intersects the first portion 290 and extends radially outwardly therefrom.

Figure 15:
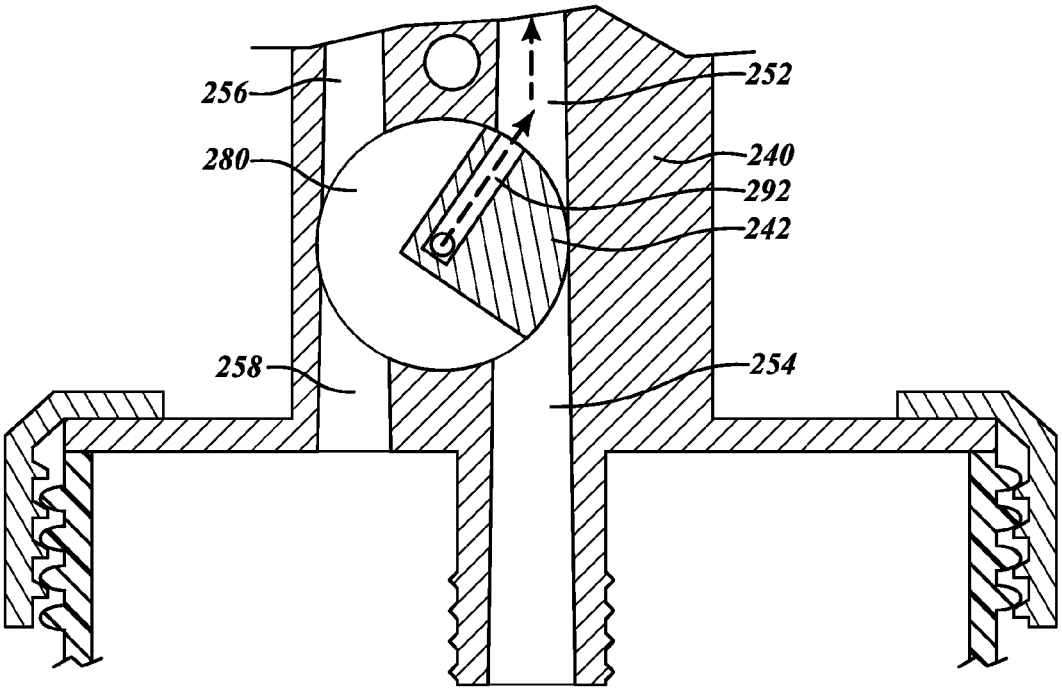
FIG. 15 is a section view similar to that of FIG. 15 but illustrating the valve member in a second position.
Figure 16:
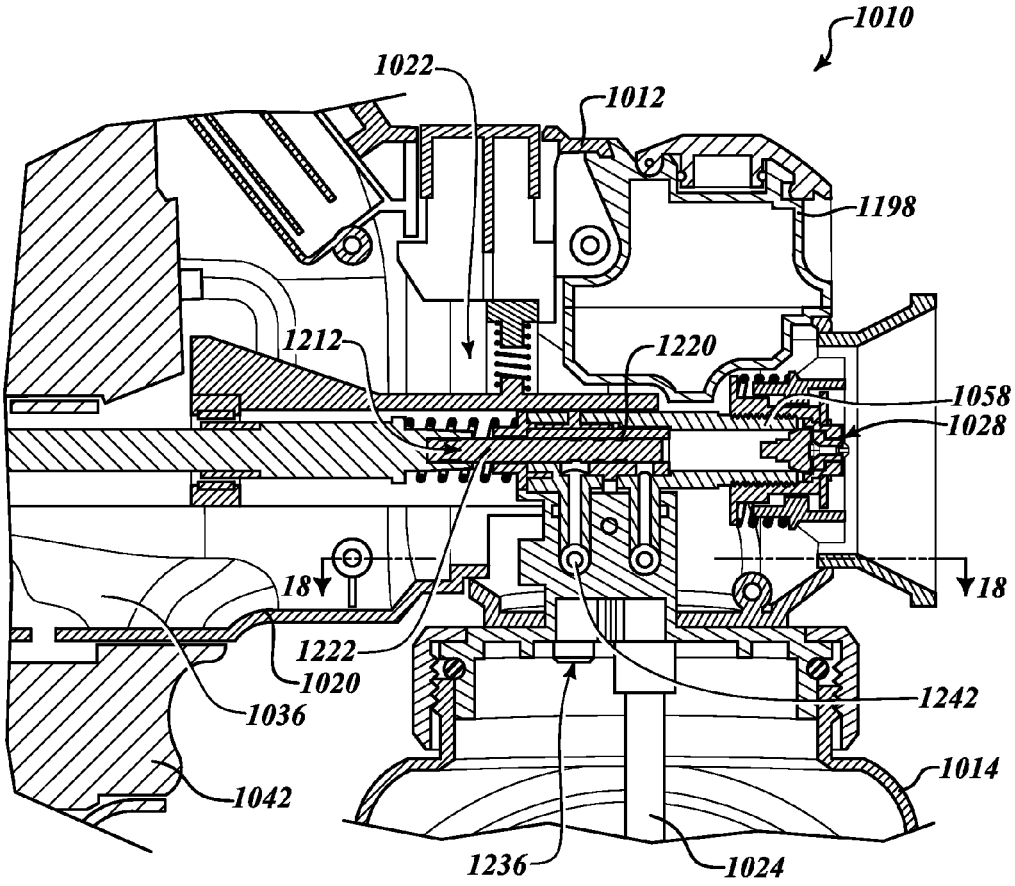
FIG. 16 is a longitudinal section view of a portion of another sprayer constructed in accordance with the present teachings.
Figure 17:
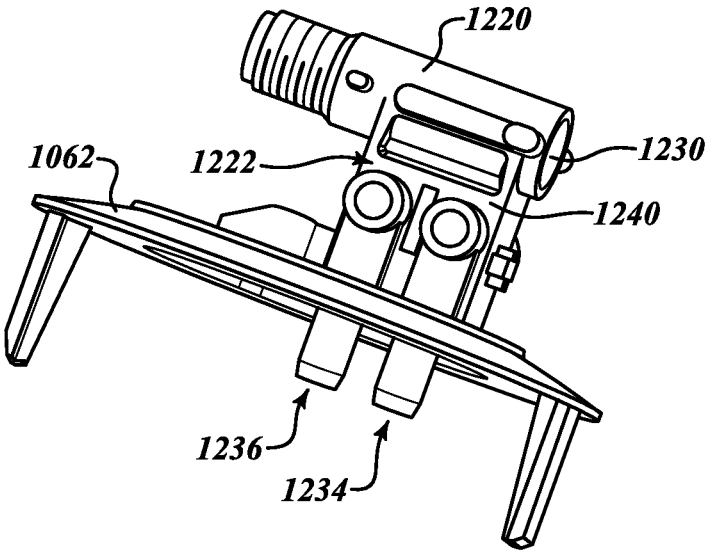
FIG. 17 is a perspective view of a portion of the sprayer of FIG. 16 illustrating a portion of a pump in more detail.
Figure 18:
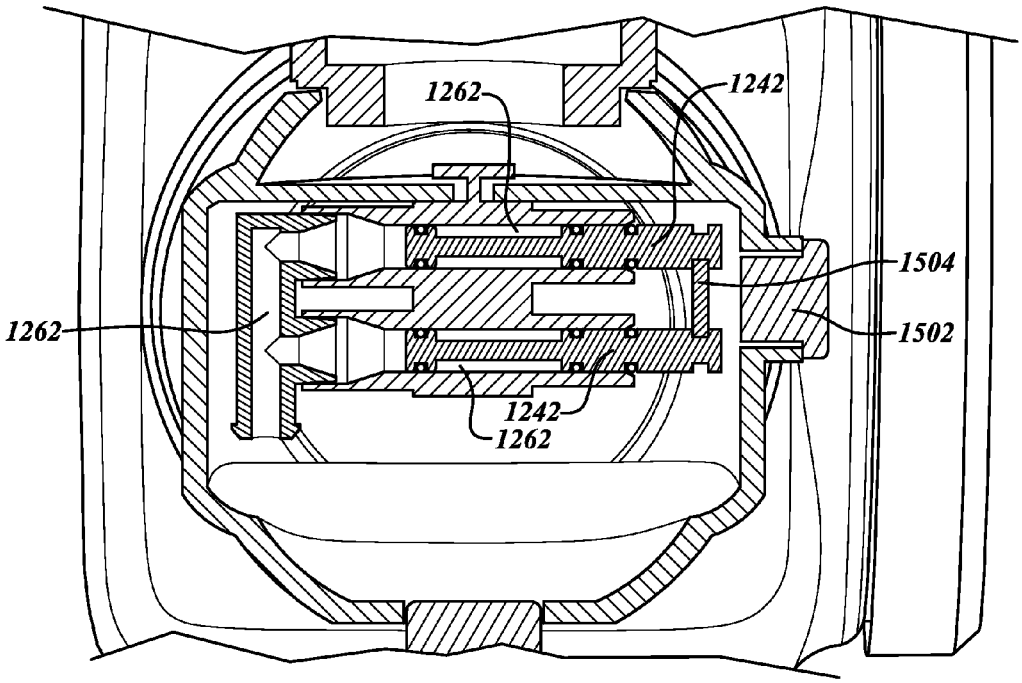
FIG. 18 is a section view taken along the line 18-18 of FIG. 16.
Figure 19:
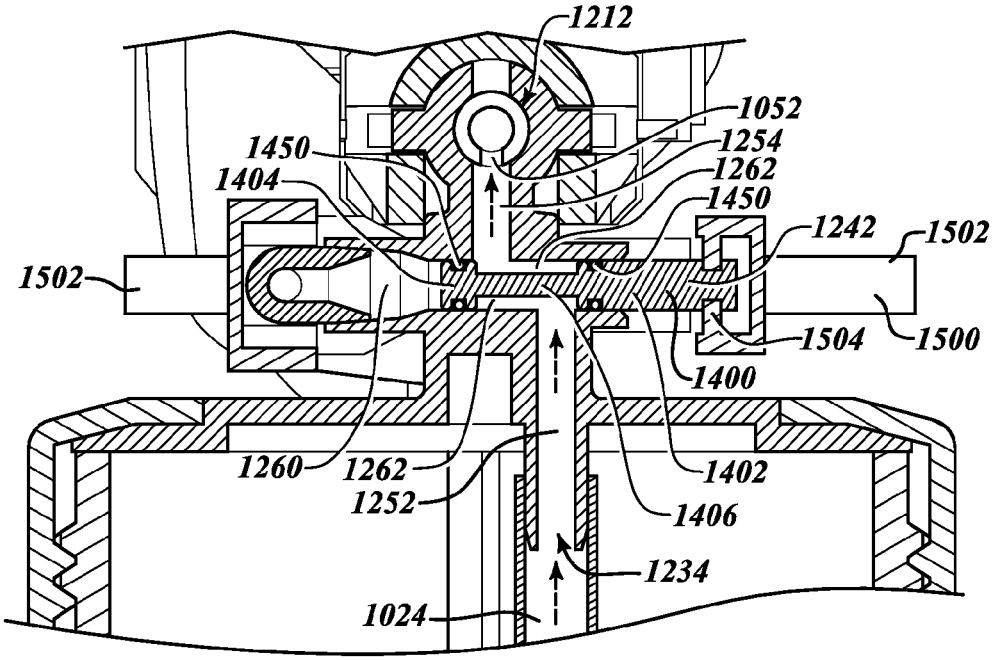
FIG. 19 is a section view taken through a portion of the sprayer of FIG. 16 illustrating another portion of the pump in more detail with one of the valve elements being disposed in a first position.
Figure 19A:
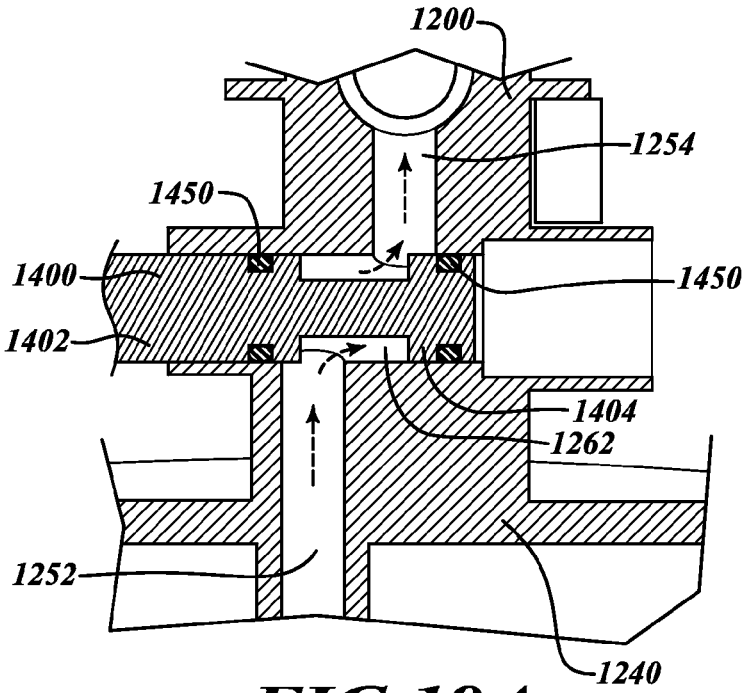
FIG. 19A is an enlarged portion of FIG. 19.
Figure 20:
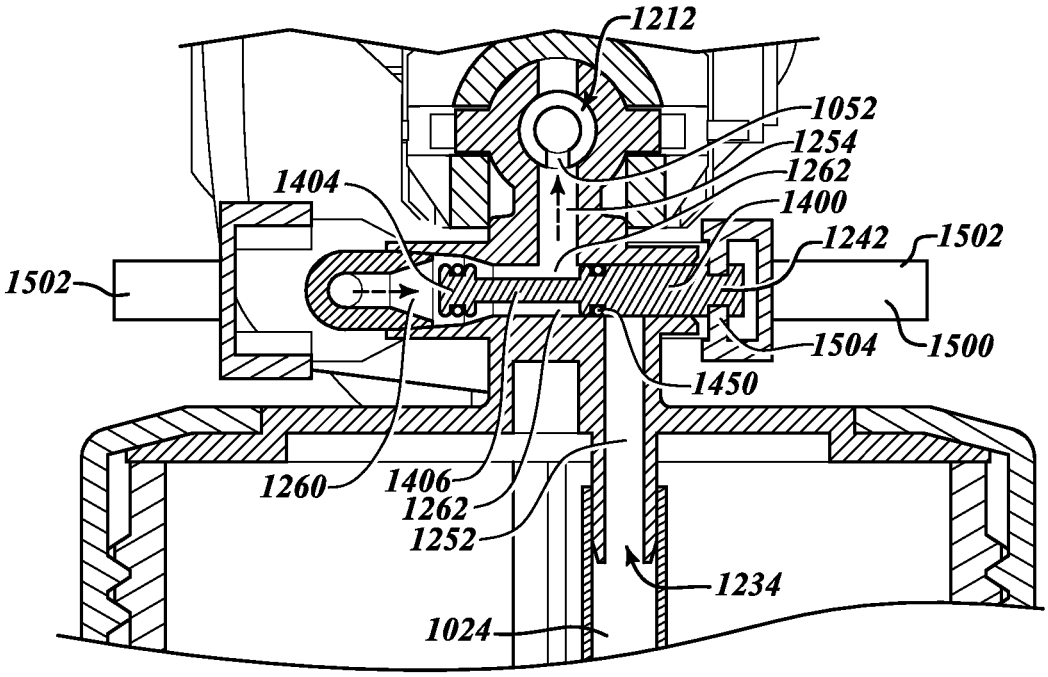
FIG. 20 is a view similar to that of FIG. 19 but depicting the one of the valve elements as disposed in a second position.
Figure 20A:
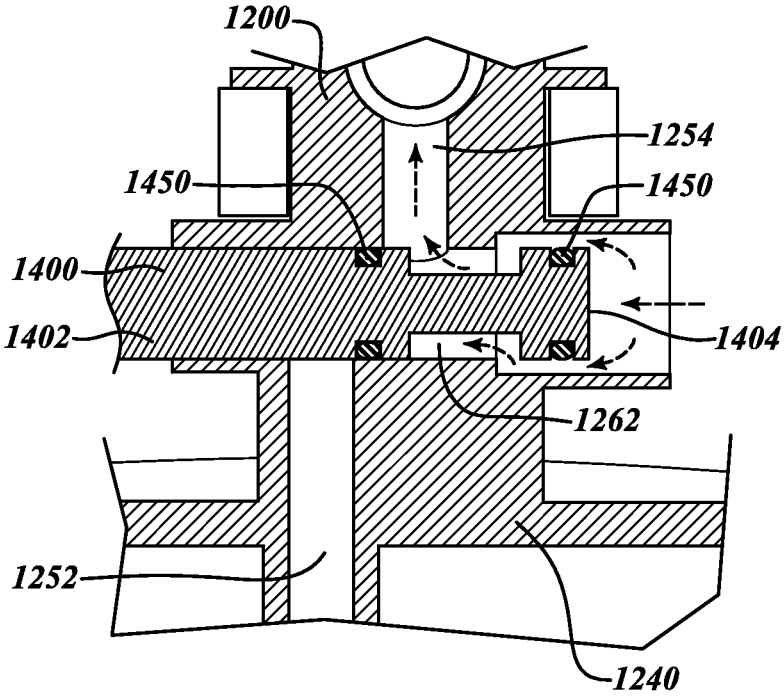
FIG. 20A is an enlarged portion of FIG. 20.
Figure 21:
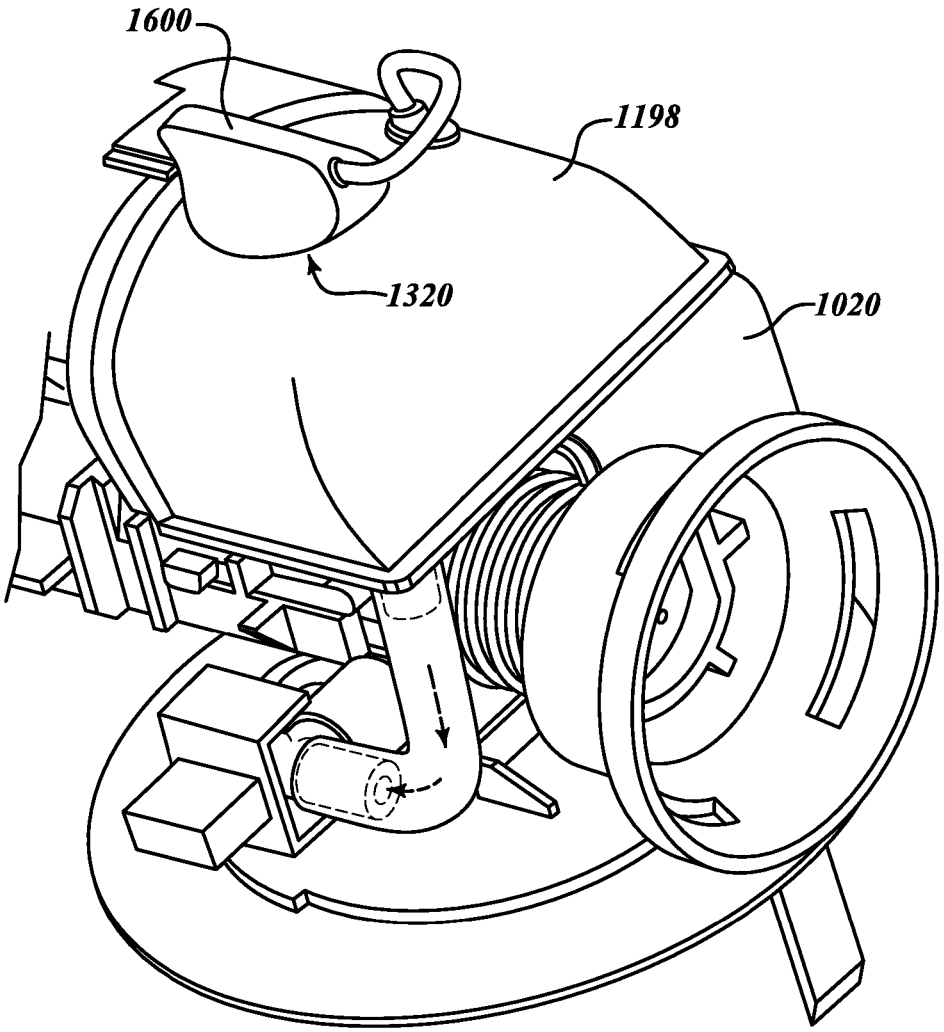
FIG. 21 is a perspective view of a portion of the sprayer of FIG. 16 illustrating the cleaning fluid reservoir and its connection to the manifold structure in more detail.
Figure 22:
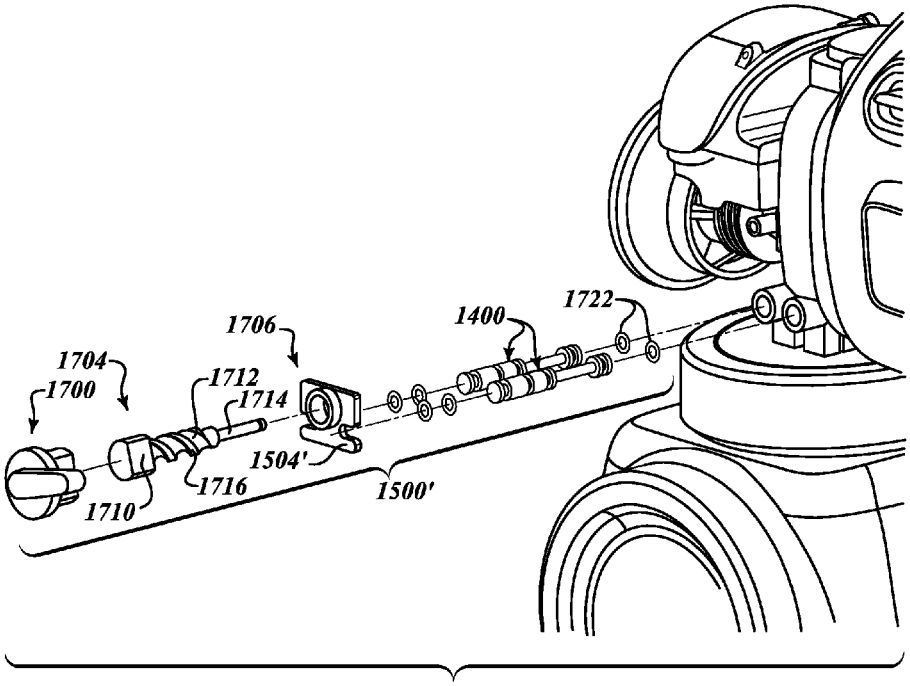
FIG. 22 is an exploded perspective view of a portion of another sprayer constructed in accordance with the teachings of the present disclosure.
Figure 23:
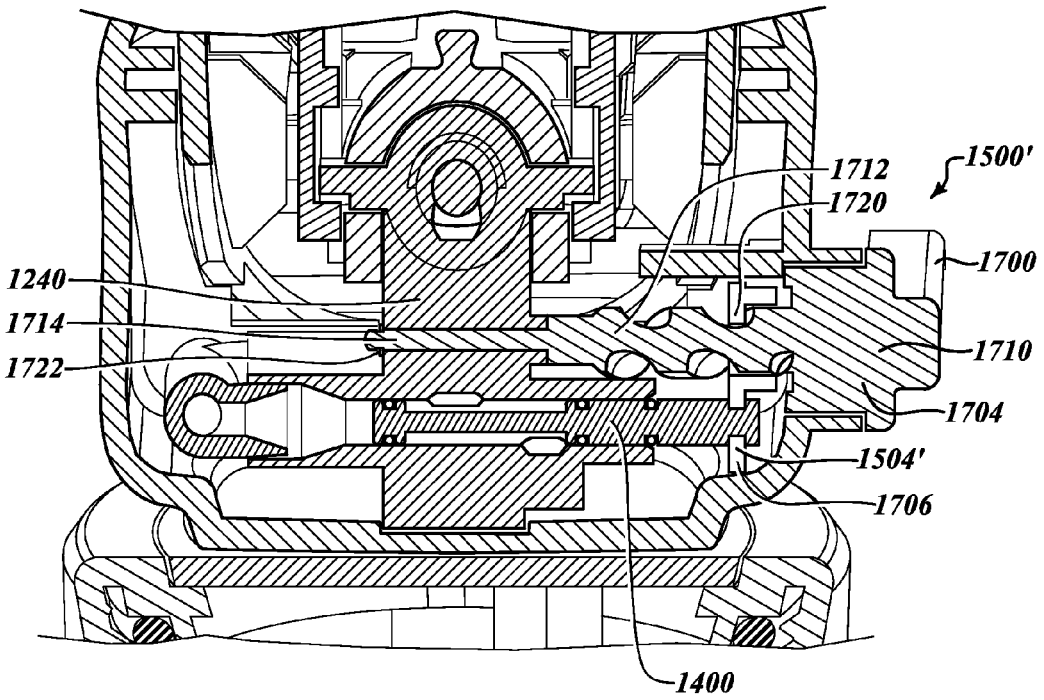
FIG. 23 is a section view taken through the pump along a longitudinal axis of one of the valve elements.
Figure 24:
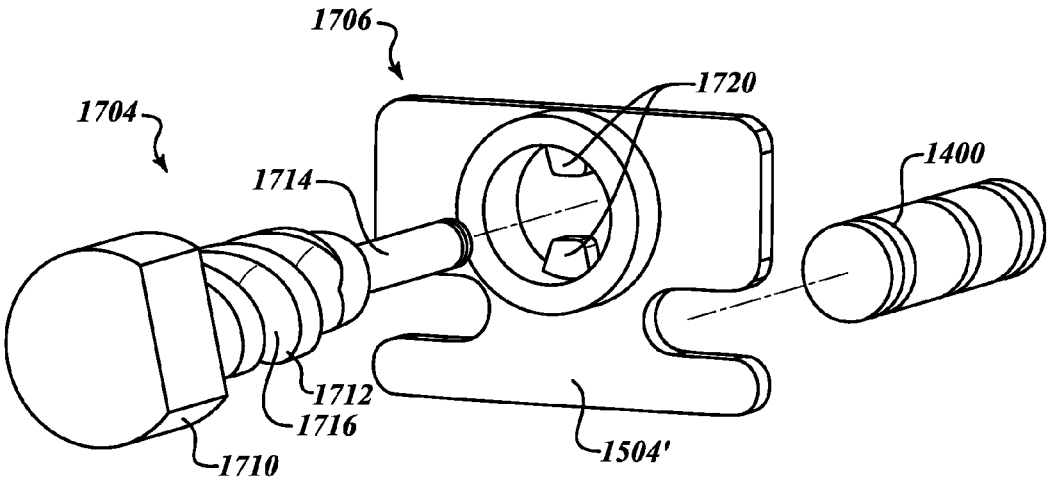
FIG. 24 is an exploded perspective view of a portion of the sprayer of FIG. 22.
Figure 25:
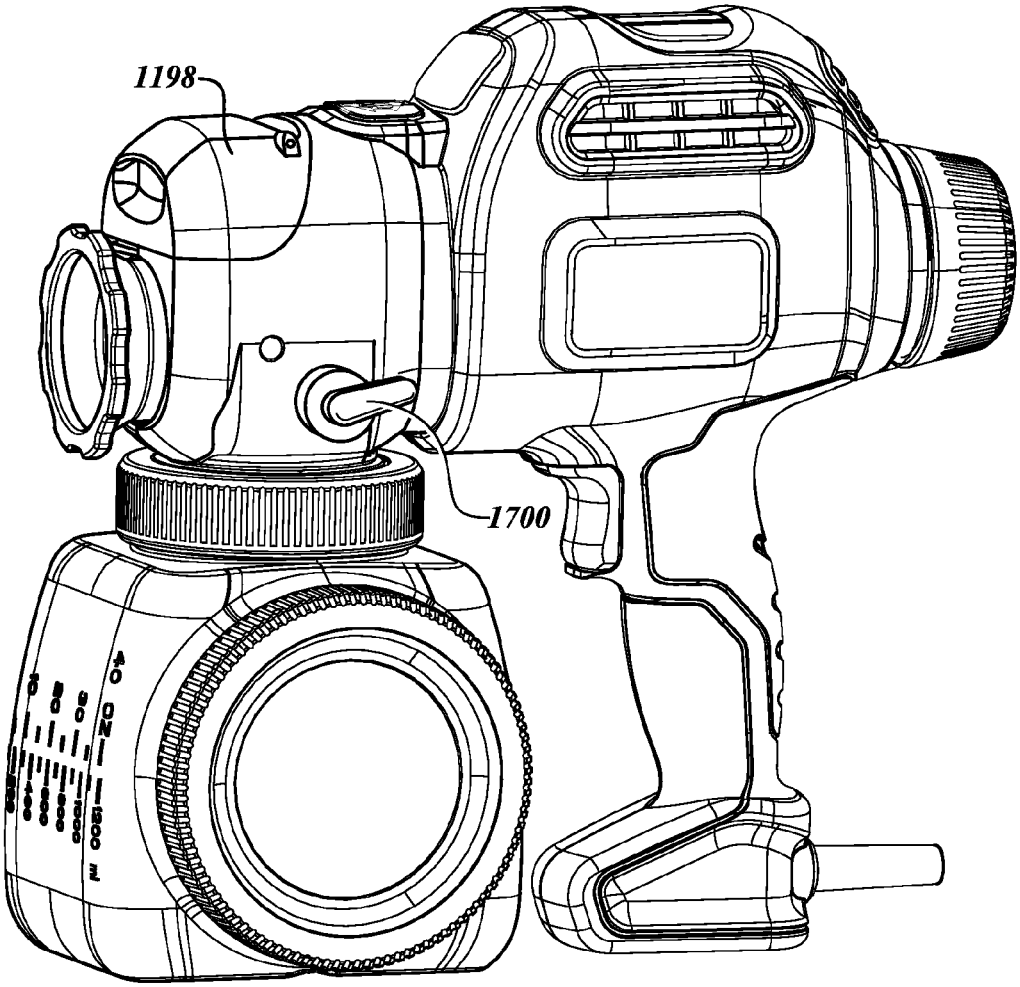
FIG. 25 is a perspective view of the sprayer of FIG. 22.

The valve member 242 may be rotated between a first position, which is shown in FIG. 14, and a second position that is shown in FIG. 15. When the valve member 242 is in the first position as shown in FIG. 14, the first valve conduit 280 couples in fluid communication the first and second supply conduits 252 and 254 and the blowback conduit 256, and the second portion 292 of the second valve conduit 282 is sealingly disposed against the wall of the manifold structure 240 that defines the valve body recess 262. When the valve member 242 is in the second position as shown in FIG. 15, the second portion 292 of the second valve conduit 282 is coupled in fluid communication with the first supply conduit 252, while the first valve conduit 280 couples the blowback conduit 256, the drain conduit 258 and the second supply conduit 254 in fluid communication with one another. Optionally, one or more seals 306 (FIG. 9) may be coupled to the valve member 242 and/or the manifold structure 240 to aid in the sealing of the valve member 242 to the manifold structure 240. With reference to FIGS. 9 and 14, the seals 306 comprise two o-rings are disposed about the circumference of the valve member 242 on opposite lateral sides of the first and second valve conduits 280 and 282 and a third o-ring that forms a face seal between the valve member 242 and the interior surface of the valve body recess 262.

Returning to FIG. 5A, the pump assembly 22-1 can comprise one or more controllers that can be employed by an operator of the sprayer 10-1 to control one or more aspects of the sprayer 10-1. In the example provided, the pump assembly 22-1 includes a trigger 42, which can be employed to selectively operate the pump assembly 22-1, and a spray adjuster 44 that can be employed to control the amount of liquid that is output from the pump assembly 22-1. The proximal end (not specifically shown) of the supply tube 24 can be coupled to the inlet 52 (FIG. 9) of the pump assembly 22-1, and the distal end of the supply tube 24 can extend into the reservoir 14*a* and engage the filter system 26. The nozzle 28 can be coupled to an output 58 (FIG. 9) of the pump assembly 22-1. The collar 30 can be fixedly coupled or fixedly but removably coupled to the housing 20-1 or the pump assembly 22-1 and can be configured to facilitate the coupling of the reservoir 14*a* to the sprayer body 12-1. In the particular example provided, the collar 30 comprises an annular threaded member 60 that can be received over the flange 62 (FIG. 9) of the pump assembly 22-1. The annular threaded member 60 may be threadably coupled to a corresponding neck 64 (FIG. 9) on the reservoir 14*a* in a manner that is well known in the art. Moreover, one or more seals may be employed between the collar 30 and the pump assembly 22-1, and/or the collar 30 and the neck 64 (FIG. 9), and/or the flange 62 (FIG. 9) and the neck 64 (FIG. 9) to seal one or more of the interfaces between the reservoir 14*a*, the pump assembly 22-1 and/or the collar 30.

Figure 7:
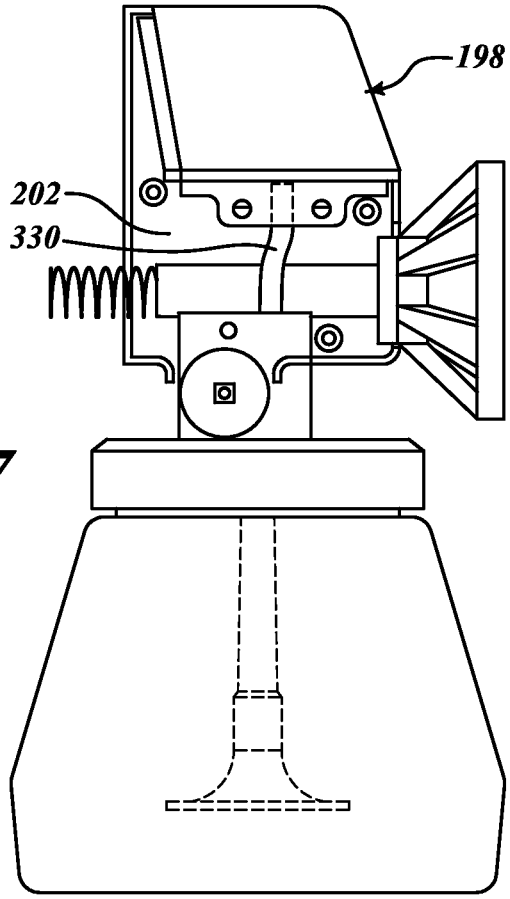
FIG. 7 is a perspective view of a portion of the sprayer of FIG. 5A.
Figure 8:
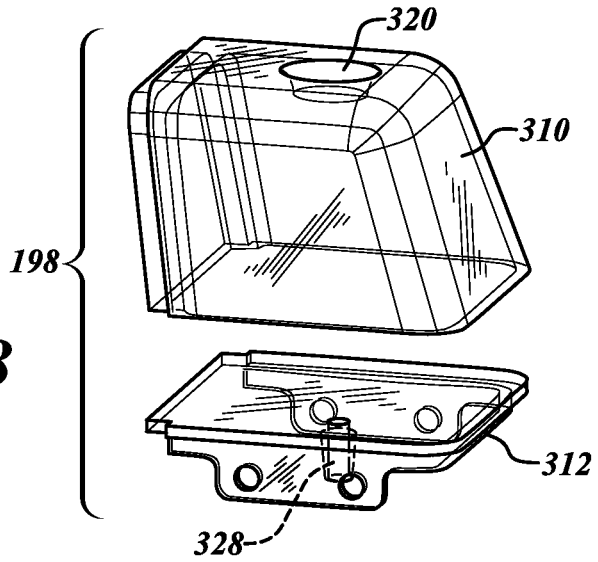
FIG. 8 is an exploded perspective view of a portion of the sprayer of FIG. 5A illustrating the cleaning fluid reservoir in more detail.

With reference to FIGS. 5A, 7 and 8, the cleaning fluid reservoir 198 can be coupled to the housing 20-1 or the pump assembly 22-1 in any manner desired. In the example illustrated, the cleaning fluid reservoir 198 is fixedly coupled to and partly housed within the second housing portion 202. The cleaning fluid reservoir 198 can be unitarily formed, but in the particular example provided comprises a first housing member 310 and a second housing member 312 that may be fixedly and sealingly coupled to one another in any appropriate manner, such as via welding and/or an adhesive. The first housing member 310 can define an inlet port 320 through which a suitable cleaning solution may be introduced into the cleaning fluid reservoir 198. In the particular example provided, the inlet port 320 comprises a funnel-shaped entry portion 322 that is configured to aid in the filling of the cleaning fluid reservoir 198. The second housing member 312 can comprise a coupling that permits the cleaning fluid reservoir 198 to be coupled in fluid communication with the cleaning solution supply conduit 260 in the manifold structure 240. In the example provided, the coupling comprises a hose barb 328 that is integrally formed with the remainder of the second housing member 312 and a hose 330 (FIGS. 7 & 9), which is secured to the hose barb 276 (FIG. 12) and the hose barb 328, is employed to fluidly couple an outlet of the cleaning fluid reservoir 198 to the cleaning solution supply conduit 260 (FIG. 10). It will be appreciated that the coupling could comprise one or more components that may be coupled to the cleaning fluid reservoir 198. It will also be appreciated that the inlet port 320 can fluidly coupled the interior of the cleaning fluid reservoir 198 with the atmosphere such that orientation of the sprayer 10-1 (FIG. 5A) in a predetermined orientation will permit cleaning solution in the cleaning fluid reservoir 198 to drain out of the coupling as will be described in more detail below.

Figure 5B:
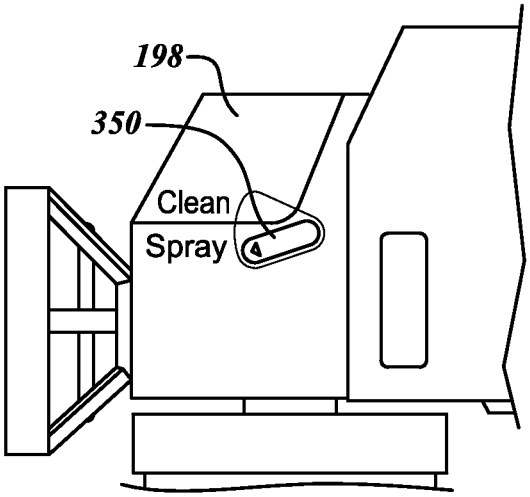
FIG. 5B is a partial left side elevation view of the sprayer of FIG. 5A.

With reference to FIGS. 6, 9, 10 and 14, the valve member 242 may be positioned in the first position via a suitable switch member 350 (FIG. 5B) to permit the sprayer 10-1 to be operated in first or liquid delivery mode in which the pump assembly 22-1 is employed to dispense liquid from the reservoir 14*a* through the nozzle 28. As noted above, placement of the switch member 350 rotates the valve member 242 into a position where the first valve conduit 280 couples in fluid communication the first and second supply conduits 252 and 254 and the blowback conduit 256 while the second portion 292 of the second valve conduit 282 is sealingly disposed against the wall of the manifold structure 240 that defines the valve body recess 262. Accordingly, operation of the pump assembly 22-1 creates a vacuum that draws liquid through the supply tube 24, the second supply conduit 254, the first valve conduit 280, the first supply conduit 252 and into the inlet aperture 234 in the pump barrel 220. As will be appreciated, translation of the piston toward the nozzle 28 within the pump barrel 220 will pressurize the fluid that resides in the pump barrel 220 between the piston and the nozzle 28 when the inlet aperture 234 is closed by the piston (i.e., when the piston moves toward the nozzle 28 by a distance that is sufficient to cover the inlet aperture 234). It will be appreciated that the pressurized fluid in the pump barrel 220 may under some circumstances leak past piston as the piston is moved toward the nozzle 28. In such situations, the leaked fluid (referred herein as blowback) is permitted to drain from the blowback aperture 236 in the pump barrel 220 to the blowback conduit 256. Fluid in the blowback conduit 256 is routed to the first supply conduit 252 by the first valve conduit 280. We have found that plumbing the blowback into the first supply conduit 252 in this manner permits the pump assembly 22-1 to generate a relatively stronger vacuum that can aid in the priming of the pump assembly 22-1 in some situations.

With reference to FIGS. 6, 8, 9, 10 and 15, the valve member 242 may be positioned in the second position via the switch member 350 (FIG. 5B) to permit the sprayer 10-1 to be operated in second or cleaning mode in which the pump assembly 22-1 is employed to pump liquid from the cleaning fluid reservoir 198 through the pump assembly 22-1 and out the nozzle 28. As noted above, placement of the valve member 242 in the second position locates the valve member 242 relative to the manifold structure 240 such that the second portion 292 of the second valve conduit 282 is coupled in fluid communication with the first supply conduit 252, which permits fluid to flow from the cleaning fluid reservoir 198, through the hose 330, the cleaning solution supply conduit 260, the second valve conduit 282, the first supply conduit 252 and into the inlet aperture 234 in the pump barrel 220, while the first valve conduit 280 couples the blowback conduit 256, the drain conduit 258 and the second supply conduit 254 in fluid communication with one another. As will be appreciated, translation of the piston toward the nozzle 28 within the pump barrel 220 will pressurize the cleaning fluid that resides in the pump barrel 220 between the piston and the nozzle 28 when the inlet aperture 234 is closed by the piston (i.e., when the piston moves toward the nozzle 28 by a distance that is sufficient to cover the inlet aperture 234). We have found that a relatively small amount of an appropriate cleaning fluid (e.g., water, paint thinner, oil) can be effective in cleaning various components of the sprayer 10-1. The cleaning fluid reservoir 198 can be configured to hold between 10 cc and 100 cc of the cleaning fluid. In the particular example provided, the cleaning fluid reservoir 198 is configured to hold 80 cc of cleaning fluid and the pump assembly 22-1 is configured to spray in excess of 6.5 gallons per hour so that dispensing of the entire contents of the cleaning fluid reservoir 198 can be completed in less than 60 seconds. We note, too, that additionally or alternatively the cleaning fluid reservoir 198 could comprise a connection that permits the sprayer 10-1 to be coupled to an external supply of cleaning fluid, such as a garden hose that is coupled to a source of potable water.

It will be appreciated that oil or other lubricating liquids could be introduced to the cleaning fluid reservoir 198 and could be employed to lubricate components of the pump assembly 22-1 (e.g., the piston, spring) and/or the nozzle 28.

With reference to FIGS. 11 through 16, another sprayer constructed in accordance with the teachings of the present disclosure is generally indicated by reference numeral 1010. The sprayer 1000 can include a sprayer body 1012 and a reservoir 1014. The sprayer body 1012 can comprise a housing 1020, a pump assembly 1022, a supply tube 1024, a nozzle 1028, and a cleaning fluid reservoir 1198.

The housing 1020 can be formed of one or more housing components, such as a pair of clam shell housing halves, and can include a housing body 1036.

The pump assembly 1022 can be received in the housing body 1036 and can include a suitable pump, such as a solenoid operated piston pump, that can be employed to draw a liquid, such as a paint or a stain, from the reservoir 1014. The pump assembly 1022 can comprise one or more controllers that can be employed by an operator of the sprayer 1010 to control one or more aspects of the sprayer 1010. In the example provided, the pump assembly 1022 includes a trigger 1042, which can be employed to selectively operate the pump assembly 1022, a spray adjuster (not specifically shown) that can be employed to control the amount of liquid that is output from the pump assembly 1022, and a piston pump 1212. The piston pump 1212 can comprise a pump cylinder or barrel 1220, a piston 1222 and a manifold assembly 1224. The pump barrel 1220 can define a central aperture 1230 that can be configured to receive the piston 1222. The piston 1222 can be reciprocated within the pump barrel 1220 to draw fluid from the reservoir 1014 and expel the fluid from the nozzle 1028. A supply or inlet aperture 1234 and a drain or blowback aperture 1236 can be formed through the pump barrel 1220 so as to intersect the central aperture 1230. The manifold assembly 1224 can comprise a flange 1062, a manifold structure 1240, and at least one valve member 1242. The manifold structure 1240 can be disposed between the pump barrel 1220 and the flange 1062 and can include a mounting aperture 1250, a first supply conduit 1252, a second supply conduit 1254, a blowback conduit (not specifically shown), a drain conduit (not specifically shown), a cleaning solution supply conduit 1260 and a valve body recess 1262.

The first supply conduit 1252 can extend between (and fluidly couple) the inlet aperture 1234 and the valve body recess 1262. The second supply conduit 1254 can extend between (and fluidly couple) the valve body recess 1262 and an inlet 1052 of the piston pump 1212. The blowback conduit can extend between (and fluidly couple) a blowback aperture (not specifically shown) and the valve body recess 1262. The drain conduit can extend from the valve body recess 1262 and extend through the flange 1062. The cleaning solution supply conduit 1260 can extend from the valve body recess 1262. In the particular example provided, valve body recess 1262 comprises a pair of cylindrical conduits that are disposed parallel to one another, but it will be appreciated that the quantity of conduits forming the valve body recess 1262 could comprise fewer or more conduits than that which is depicted here.

The valve member 1242 can be received in the valve body recess 1262 and can be moved to control the flow of fluid through the manifold structure 1240. In the particular example provided, the valve member 1242 comprises a pair of valve elements 1400, with each valve element 1400 being received in a corresponding one of the cylindrical conduits that comprise the valve member 1242. Each valve element 1400 can include a first engaging portion 1402, a second engaging portion 1404, and a body portion 1406 that can extend between the first and second engaging portions 1402 and 1404. Each valve element 1400 can be translated within the valve body recess 1262 between a first position, which is illustrated in FIGS. 14 and 14A, and a second position that is illustrated in FIGS. 15 and 15A.

With reference to FIGS. 14 and 14A, when the valve elements 1400 are positioned in the first position, the first and second engaging portions 1402 and 1404 are disposed within the manifold structure 1240 to permit the flow of fluid from the first supply conduit 1252 through the valve body recess 1262 and into the second supply conduit 1254 while simultaneously blocking the flow of fluid from the cleaning solution supply conduit 1260 into the valve body recess 1262. Seals, such as o-rings 1450 can be carried by the first and second engaging portions 1402 and 1404 and can be sealingly engaged to the manifold structure 1240 such that fluid entering the valve body recess 1262 from the first supply conduit 1252 can flow between the o-ring seals 1450 and around the relatively smaller diameter body portion 1406 as the fluid flows to the second supply conduit 1254.

With reference to FIGS. 15 and 15A, when the valve elements 1400 are positioned in the second position, the first and second engaging portions 1402 and 1404 are disposed within the manifold structure 1240 to permit the flow of fluid from the cleaning solution supply conduit 1260 to the valve body recess 1262 and into the second supply conduit 1254 while simultaneously blocking the flow of fluid from the first supply conduit 1252 into the valve body recess 1262. It will be appreciated that the flow of fluid from the first supply conduit 1252 will be trapped between by the o-ring seal 1450 on the first engaging portion 1402 and will not be able to flow into the valve body recess 1262, while the fluid in the cleaning solution supply conduit 1260 can flow around the second engaging portion 1254 (and the o-ring seal 1450 received thereon) into the valve body recess 1262.

Returning to FIGS. 11 through 16, an actuator 1500 can be coupled to the valve elements 1400 to coordinate their movement in a desired manner. In the particular example provided, a pair of slider buttons 1502 is coupled to the opposite axial ends of the valve elements 1400 and can be employed to selectively translate the valve elements 1400 along their longitudinal axes between their first and second positions. The slider buttons 1502 can be coupled to the valve elements 1400 in any desired manner. In the particular example provided, the slider buttons 1502 include a yoke 1504 that can be fixedly coupled to the ends of the valve elements 1400 that extend from the manifold structure 1240.

The supply tube 1024 can have a proximal end 1050, which can be coupled to the inlet 1052 of the pump assembly 1022, and a distal end (not shown) that can extend into the reservoir 1014. The nozzle 1028 can be coupled to an output 1058 of the pump assembly 1022.

The cleaning fluid reservoir 1198 can be coupled to the housing 1020 or the pump assembly 1022 in any manner desired. In the example illustrated, the cleaning fluid reservoir

1198 is fixedly coupled to and partly housed within the housing body 1036. The cleaning fluid reservoir 1198 can be unitarily formed and can define an inlet port 1320 through which a suitable cleaning solution may be introduced into the cleaning fluid reservoir 1198. In the particular example provided, the inlet port 1320 is closed via a removable top 1600. The cleaning fluid reservoir 1198 can also comprise a coupling that permits the cleaning fluid reservoir 1198 to be coupled in fluid communication with the cleaning solution supply conduit 1260 in the manifold structure 1240. It will be appreciated that the coupling could comprise one or more components that may be coupled to the cleaning fluid reservoir 1198. It will also be appreciated that the inlet port 1320 can fluidly couple the interior of the cleaning fluid reservoir 1198 with the atmosphere such that orientation of the sprayer 1010 in a predetermined orientation will permit cleaning solution in the cleaning fluid reservoir 1198 to drain out of the coupling.

From the foregoing, it will be appreciated that slider buttons 1502 can be employed to position the valve elements 1400 in the first position to permit a fluid in the reservoir 1014, such as paint, to be dispensed from the nozzle 1028 and that the slider buttons 1502 can be employed to position the valve elements 1400 in the second position to permit a fluid in the cleaning fluid reservoir 1198 to be dispensed from the nozzle 1028 to thereby clean the pump assembly 1022.

We have found that a relatively small amount of an appropriate cleaning fluid (e.g., water, paint thinner, oil) can be effective in cleaning various components of the sprayer 1010. The cleaning fluid reservoir 1198 can be configured to hold between 10 cc and 100 cc of the cleaning fluid. In the particular example provided, the cleaning fluid reservoir 1198 is configured to hold 80 cc of cleaning fluid and the pump assembly 1022 is configured to spray in excess of 6.5 gallons per hour so that dispensing of the entire contents of the cleaning fluid reservoir 1198 can be completed in less than 60 seconds. We note, too, that additionally or alternatively the cleaning fluid reservoir 1198 could comprise a connection that permits the sprayer 1010 to be coupled to an external supply of cleaning fluid, such as a garden hose that is coupled to a source of potable water.

It will be appreciated that oil or other lubricating liquids or another type of paint or stain could be introduced to the cleaning fluid reservoir 1198 and could be employed to lubricate components of the pump assembly 1022 (e.g., the piston, spring) and/or the nozzle 28 or to dispense a second color paint or stain.

While the actuator 1500 for moving the valve elements 1400 has been illustrated and described as being configured to receive a manual sliding input to correspondingly translate the valve elements, it will be appreciated that other types of actuators could be employed in the alternative. In the example of FIGS. 17 through 20, the actuator 1500' is a rotary actuator having an input knob 1700, a worm drive 1704, and a worm plate 1706.

The input knob 1700 is configured to be non-rotatably coupled to the worm drive 1704 and includes a generally D-shaped aperture (not specifically shown) that is configured to engage (via an interference fit) a correspondingly D-shaped shaft segment 1710 formed on the worm drive 1704. The worm drive 1704 can further comprise a worm member 1712 and a shaft portion 1714. The worm member 1712 can define a helical driving surface 1716 that is configured to engage teeth or members 1720 formed on the worm plate 1706. The shaft portion 1714 can be mounted to the manifold structure 1240 such that the worm drive 1704 can rotate relative to the manifold structure 1240 but does not move axially relative to the manifold structure 1240. In the particular example provided, an external snap ring 1722 is received over the shaft portion 1714 and abutted against the manifold structure 1240 on a side of the manifold structure 1240 opposite the input knob 1700. The worm plate 1706 can be received on the worm member 1712 such that the members 1720 are engaged to the helical driving surface 1716. The worm plate 1706 can further include a yoke 1504' that can be axially fixed to the valve elements 1400.

Rotation of the input knob 1700 can cause corresponding rotation of the worm drive 1704. Since the worm drive 1704 is axially fixed to the manifold structure 1240, rotation of the worm drive 1704 will cause movement of the worm plate 1706. The coupling of the worm plate 1706 to the valve elements 1400 will inhibit rotation of the worm plate 1706 relative to the manifold structure 1240 and as such, the worm plate 1706 and the valve elements 1400 will translate axially in response to rotation of the input knob 1700/worm drive 1704.

The foregoing description of the exemplary aspects of the present teachings has been provided for purposes of illustration and description. Individual elements or features of a particular aspect of the present teachings are generally not limited to that particular aspect, but, where applicable, are interchangeable and can be used in other aspects, even if not specifically shown or described. The same may also be varied in many ways. Such variations are not to be regarded as a departure from the present teachings, and all such modifications are intended to be included within the scope of the present teachings.

What is claimed is:

1. A sprayer comprising:

a sprayer body having a housing, a pump assembly, a supply tube, and a nozzle, the pump assembly being housed in the housing, the supply tube being coupled in fluid communication with the pump assembly, the nozzle being coupled in fluid communication with the pump assembly, the pump assembly including:

a pump barrel that defines a central aperture;

a piston arranged within the central aperture;

a solenoid coupled to the piston and configured to reciprocate the piston within the central aperture during operation of the sprayer; and a manifold assembly coupled to the pump barrel and including a valve member movable between a first position and a second position;

a first fluid reservoir coupled to the sprayer body at a first location, the supply tube being received in the first fluid reservoir;

a second fluid reservoir coupled to the sprayer body at a second location, the second location being spaced apart from the first location such that the second fluid reservoir is located remotely from the first fluid reservoir;

wherein the valve member fluidly couples the central aperture with the first fluid reservoir when the valve member is in the first position, and wherein the valve member fluidly couples the central aperture with the second fluid reservoir when the valve member is in the second position.

2. The sprayer of claim 1, wherein the valve member is rotated between the first and second positions.

3. The sprayer of claim 1, wherein the manifold assembly further includes a manifold structure and a flange, the manifold structure being disposed between the pump barrel and the flange and including a first supply conduit, a second supply conduit and a cleaning solution supply conduit.

4. The sprayer of claim 3, wherein the valve member includes a first valve conduit and a second valve conduit, the valve member fluidly coupling the first valve conduit with the central aperture in the first position and fluidly coupling the second valve conduit with the central aperture in the second position.

5. The sprayer of claim 4, wherein the second valve conduit is sealingly disposed with the manifold structure in the first position.

6. The sprayer of claim 5, wherein the second valve conduit is fluidly coupled with the cleaning fluid reservoir.

7. The sprayer of claim 1, wherein the valve member is translated between the first and second positions.

8. The sprayer of claim 7, wherein the valve member includes at least one valve element, the at least one valve element including a first engaging portion, a second engaging portion and a body portion extending between the first and second engaging portion.

9. The sprayer of claim 8, wherein the manifold assembly further includes a manifold structure and a flange, the manifold structure being disposed between the pump barrel and the flange.

10. The sprayer of claim 9, wherein the second engaging portion sealingly engages the manifold structure in the first position to block fluid flow from the cleaning fluid reservoir into the central aperture.

11. The sprayer of claim 9, wherein the first engaging portion sealingly engages the manifold structure in the second position to block fluid flow from the reservoir into the central aperture.

12. The sprayer of claim 7, further comprising an actuator that translates the valve member between the first and second positions.

13. The sprayer of claim 12, wherein the actuator includes a pair of slider buttons coupled to the valve member.

14. The sprayer of claim 12, wherein the actuator includes a rotary actuator.

15. The sprayer of claim 14, wherein the rotary actuator includes an input knob, a worm drive and a worm plate.

16. The sprayer of claim 14, wherein rotation of the input knob rotates the worm drive, rotation of the worm drive translates the worm plate and translation of the worm plate translates the valve member.

* * * * *